US009352243B2

(12) United States Patent
Saha

(10) Patent No.: US 9,352,243 B2
(45) Date of Patent: May 31, 2016

(54) OPTICAL ART KITS AND PUPPETS WITH ORIGAMI CELLOPHANE, ADHESIVE TAPE, PHOTOELASTIC MODELS, POLARISCOPES, KNITTING, AND DIFFRACTION FILMS

(76) Inventor: Pamela Saha, Brooklyn, NY (US)

( * ) Notice: Subject to any disclaimer, the term of this patent is extended or adjusted under 35 U.S.C. 154(b) by 576 days.

(21) Appl. No.: 12/931,810

(22) Filed: Feb. 11, 2011

(65) Prior Publication Data

US 2012/0206803 A1 Aug. 16, 2012

Related U.S. Application Data

(60) Provisional application No. 61/317,686, filed on Mar. 25, 2010.

(51) Int. Cl.

| | |
|---|---|
| ***A63H 17/26*** | (2006.01) |
| ***A63H 33/16*** | (2006.01) |
| ***A63H 33/22*** | (2006.01) |

(52) U.S. Cl.

CPC ..... *A63H 33/16* (2013.01); *A63H 33/22* (2013.01)

(58) Field of Classification Search

USPC ..... 446/488, 83, 85, 97, 219, 485, 363

See application file for complete search history.

(56) References Cited

U.S. PATENT DOCUMENTS 2,007,421 A * 7/1935 Coughlin ..... A63F 9/06 446/488
2,038,022 A * 4/1936 Zubli ..... B44F 1/06 273/157 A
2,112,723 A * 3/1938 Wisoff ..... A41G 1/00 156/61
2,120,365 A * 6/1938 Kriebel ..... G02C 7/12 351/49
2,184,999 A * 12/1939 Land ..... G02B 27/288 359/489.07
2,274,706 A * 3/1942 Keim ..... G02B 5/3033 156/235
2,293,696 A * 8/1942 Burchell ..... B44F 1/10 101/211
2,333,641 A * 11/1943 Corwin ..... B44F 1/04 250/467.1
2,699,706 A * 1/1955 Boone ..... G02B 5/285 359/489.18
2,763,078 A * 9/1956 Graves ..... G09F 13/00 359/489.19
3,034,395 A * 5/1962 Zandman ..... G01L 1/241 356/34
3,089,802 A * 5/1963 Coffman ..... G02B 27/28 144/144.51
3,216,312 A * 11/1965 Oppel ..... G01B 11/18 356/33
3,415,590 A * 12/1968 Adler ..... G02B 27/28 359/489.19

(Continued)

OTHER PUBLICATIONS

Chickenpow, Feb. 4, 2010, DeviantArt.com, pp. 1-4.*

(Continued)

*Primary Examiner* — Gene Kim
*Assistant Examiner* — Matthew B Stanczak
(74) *Attorney, Agent, or Firm* — Symbus Law Group, LLC; Clifford D. Hyra

(57) ABSTRACT

Kits for creating optical art come with precut cellophane and/or adhesive tape and instructions for folding the cellophane into origami structures having desired optical qualities and/or applying the adhesive tape in a layered fashion to achieve desired optical properties. Adhesive tape or cellophane cut into specific decorative shapes is provided on a tape roll or sheet for easily peeling it off and applying it to create optical art. Tools are provided for cutting, punching out, or otherwise shaping provided cellophane and/or tape. Instruments such as polarizing films, light sources, and/or polarizing glasses are provided for viewing the optical art under polarized light. These instruments may include toy polariscopes, particularly having an ergonomic design. Diffusion lenses are provided to enhance the viewing experience. Photoelastic models and puppets may also be provided.

25 Claims, 42 Drawing Sheets
(2 of 42 Drawing Sheet(s) Filed in Color)

(56) References Cited

U.S. PATENT DOCUMENTS

| | | | | | |
|---|---|---|---|---|---|
| 3,536,378 | A * | 10/1970 | Bishop | G02B 27/22 | 356/154 |
| 4,925,429 | A * | 5/1990 | Kaulfuss | A63H 33/16 | 446/487 |
| 5,191,214 | A * | 3/1993 | Hiranami | B41M 5/28 | 250/316.1 |
| 6,112,425 | A * | 9/2000 | Nelson | B43L 13/205 | 33/563 |
| 6,594,927 | B2 * | 7/2003 | Witkowski | G09F 3/0288 | 40/306 |
| 6,985,214 | B2 * | 1/2006 | Szaroletta | G01B 11/18 | 356/34 |
| 7,430,038 | B2 * | 9/2008 | Szaroletta | G01B 11/18 | 356/32 |
| 7,477,386 | B2 * | 1/2009 | Saha | G01B 11/18 | 356/364 |
| 7,936,458 | B2 * | 5/2011 | Saha | G01B 11/18 | 356/364 |
| 8,233,099 | B1 * | 7/2012 | Comarow | A63H 33/22 | 349/10 |
| 8,582,063 | B2 * | 11/2013 | Comarow | A63H 33/22 | 349/122 |
| 2003/0217489 | A1 * | 11/2003 | Witkowski | B44C 1/175 | 40/306 |
| 2005/0164596 | A1 * | 7/2005 | Saha | A63H 33/22 | 446/131 |
| 2008/0113578 | A1 * | 5/2008 | McAlaine | A63H 33/22 | 446/75 |
| 2009/0091046 | A1 * | 4/2009 | Saha | G01B 11/18 | 264/1.7 |
| 2012/0289119 | A1 * | 11/2012 | Comarow | A63H 33/22 | 446/219 |

OTHER PUBLICATIONS

Papersculpture, How to make finger puppets from paper. Origami for children, Apr. 28, 2010, www.ucandostuff.com, 3 pages.*

* cited by examiner

OPTICAL ART KITS AND PUPPETS WITH ORIGAMI CELLOPHANE, ADHESIVE TAPE, PHOTOELASTIC MODELS, POLARISCOPES, KNITTING, AND DIFFRACTION FILMS

This application claims the benefit of provisional patent application No. 61/317,686, filed Mar. 25, 2010, which is hereby incorporated by reference in its entirety.

BACKGROUND

The present invention relates generally to optical toys and art.

Overlapping cellophane has been applied to create famous art work called "polages". "Polage" art sandwiches layered cellophane between polarizing filters, uses a light source and works by transmission, creating vibrant colors when the sandwiched cellophane is exposed to the light source. Optical properties are otherwise rarely if ever used in art or toys, despite the beautiful effects that can be obtained. Needs exist for methods and kits for creating art that takes advantage of optical properties of materials. Needs exist for toys that take advantage of optical properties of materials.

SUMMARY

It is to be understood that both the following summary and the detailed description are exemplary and explanatory and are intended to provide further explanation of the invention as claimed. Neither the summary nor the description that follows is intended to define or limit the scope of the invention to the particular features mentioned in the summary or in the description.

In certain embodiments, the disclosed embodiments may include one or more of the features described herein.

A new toy has transparent or translucent cellophane cut into specific dimensions for the purpose of creating origami models by folding that show optical effects by diffraction and interference when viewed under polarized light. A new kit has the toy and comes with directions for making origami models by folding translucent or transparent cellophane for the purpose of creating optical effects such as rainbow colors due to light diffraction and interference patterns when viewed under polarized light. The cellophane in one embodiment glows in the dark.

In one embodiment optical effects are produced by viewing a folded origami cellophane model with transmitted light from a light source through a polarizing film, then through the folded origami cellophane model, and then through another polarizing film or polarizing glasses. In one embodiment optical effects are produced by viewing the folded origami cellophane model with transmitted light from the polarizing effects of the blue sky, through the folded cellophane model, and through one polarizing film or polarizing glasses. In one embodiment optical effects are produced by viewing the folded origami cellophane model with transmitted light from ambient light though two polarizing films with the folded origami cellophane model between them. In one embodiment optical effects are produced by viewing the folded origami cellophane model with reflected light that first is polarized by reflection from a mirrored surface, a mirrored surface that has a polarizing film over it or a black reflected surface or other reflective surface, then through the folded origami cellophane model, and then through a another polarizing film or polarizing glasses.

A new kit includes adhesive tape and instructions for creating optical effects using the adhesive tape to form diffraction and interference patterns that show rainbow colors when viewed under polarized light. In one embodiment the adhesive tape glows in the dark.

In one embodiment optical effects are produced by viewing the adhesive tape with transmitted light from a light source through a polarizing film, then through the adhesive tape, and then through another polarizing film or polarizing glasses. In one embodiment optical effects are produced by viewing the adhesive tape with transmitted light from the polarizing effects of the blue sky, through the adhesive tape, and through one other polarizing film or polarizing glasses. In one embodiment optical effects are produced by viewing the adhesive tape with transmitted light from ambient light though two polarizing films with the adhesive tape between them. In one embodiment optical effects are produced by viewing reflected light that first is polarized by reflection from a mirrored surface, an mirrored surface that has a polarizing film over it or a black reflected surface or other reflective surface with or without polarizing film over it, then through the adhesive tape, and then through a another polarizing film or polarizing glasses.

A new kit has adhesive tape with instructions, a cutting surface, and tools for cutting, shaping, or punching out segments of tape for creating patterns of overlapping tape that will show rainbow colors when viewed under polarized light. In one embodiment the adhesive tape kit or a cellophane toy kit includes one or more polarizing films, a light, reflective surfaces such as a mirrored surface, or black glossy or other glossy surfaces.

A new toy includes a diffraction lens that is part of polarizing glasses or armless glasses and made to fit over the arms of the polarizing glasses so that the diffraction lens is between the viewer's eyes and the polarizing film of the glasses, thereby enhancing the optical effects observed with adhesive tape or folded cellophane, or photoelastic models. In one embodiment the toy includes a photoelastic object or objects that are pre-stressed and show rainbow colors under polarized light. In one embodiment the photoelastic object/objects is/are not pre-stressed and only show the rainbow colors when stressed by bending, stretching, squeezing, touching, twisting or compressing. In some embodiments, a photoelastic puddy is included. This photoelastic puddy is a stretchable, moldable material that is photoelastic. Rubber cement-like material can be reprocessed to function as this type of material. In one embodiment, the diffraction lens/lenses are a separate film for observing the optical effects of folded origami cellophane, adhesive tape, and/or a photoelastic/photoplastic object/objects.

These and other objectives and features of the invention are apparent in the disclosure, which includes the above and ongoing written specification.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

The accompanying drawings, which are incorporated herein and form a part of the specification, illustrate exemplary embodiments and, together with the description, further serve to enable a person skilled in the pertinent art to make and use these embodiments and others that will be apparent to those skilled in the art.

DETAILED DESCRIPTION

Figure 1:
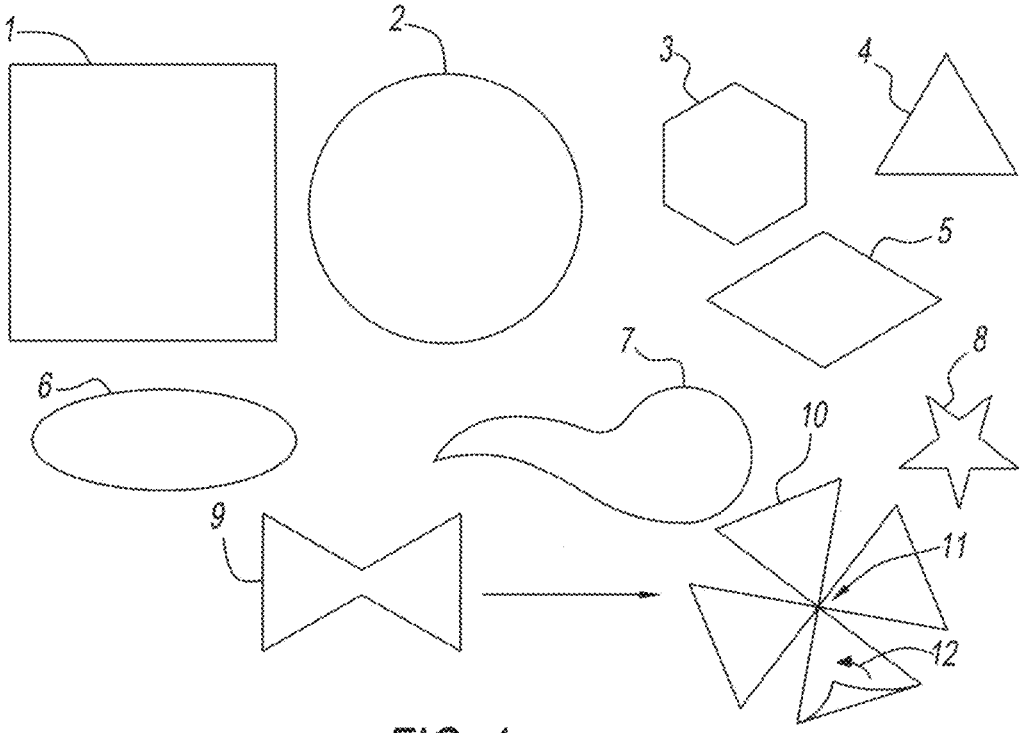
FIG. 1 is a diagram illustrating transparent or translucent Cellophane cut into specific dimensions for creating origami models.

Optical art kits and puppets with origami cellophane, adhesive tape, photoelastic models, polariscopes, knitting, and diffraction films will now be disclosed in terms of various exemplary embodiments. This specification discloses one or more embodiments that incorporate features of the invention. The embodiment(s) described, and references in the specification to "one embodiment", "an embodiment", "an example embodiment", etc., indicate that the embodiment(s) described may include a particular feature, structure, or characteristic. Such phrases are not necessarily referring to the same embodiment. When a particular feature, structure, or characteristic is described in connection with an embodiment, persons skilled in the art may effect such feature, structure, or characteristic in connection with other embodiments whether or not explicitly described.

In the several figures, like reference numerals may be used for like elements having like functions even in different drawings. The figures are not to scale. The embodiments described, and their detailed construction and elements, are merely provided to assist in a comprehensive understanding of the invention. Thus, it is apparent that the present invention can be carried out in a variety of ways, and does not require any of the specific features described herein. Also, well-known functions or constructions are not described in detail since they would obscure the invention with unnecessary detail. In black and white drawings, wavy lines within an object generally indicate rainbow colors.

Embodiments offer new experiences in both art and science by expanding the worlds of origami, knitting, stitching and puppeteering to include the rich magical world of optics and physics. Both children and adults can enjoy the experience of awe as they explore the beautiful rainbow colors created with transparent and translucent cellophane, adhesive tape, and photoelastic stretchable fibers woven together to create all kinds of patterns, shapes and models. All of these models, artistic creations, and optical puppets created out of cellophane, tape, and photoelastic material can be combined with plays, stories, and music.

In various embodiments, a comprehensive new entertaining and educational optical science and art system is provided for kids. Children learn about the optical effects revealed by polarized light using polariscopes and other light polarizing mechanisms, such as a polarizing film or glasses used in conjunction with a blue sky or LCD screen. Various types of optical art or toys, including those made of photoelastic material or layered adhesive tape and/or cellophane, reveal spectacular optical effects when viewed under polarizing light. Kits allow children to create their own optical art from scratch, assemble provided materials into optical art, or play with optical art or toys that are provided. Similarly, children can create the polariscope and other viewing implements themselves with provided material, or these materials can be provided in a finished form.

In embodiments of the system, children can combine optical art or toys into novel combinations by attaching them to one another in various ways. Photoelastic objects may be models, action figures, or other toys like puzzle pieces of building blocks that are excellent for revealing optical properties in the materials. All the pieces of the system are configured to be used together. The optical art and toys are sized to be viewed within the polariscope, or to be affixed to a polarizing film that is provided. The optical art or toys are designed to be used together, to connect or affix to one another, and/or to be combined into play scenes and new artistic objects. The components may be modular and interchangeable. Different optical art and toys can be viewed in the same polariscope or other viewing mechanism, and different polariscopes or viewing mechanisms of the system can be used to view the same (or different) piece of optical art or optical toy. The optical art or toys can be used together in varying combinations.

In one embodiment all this is enhanced with the remarkable magnification of an already dazzling experience with diffraction lenses. The art and models in some embodiments are made with tape or cellophane that comprise parts or whole creations that glow in the dark and have a variety of colors and optical effects. The puppets likewise can glow in the dark or have parts that glow in the dark.

In various embodiments, a variety of optical properties are utilized, including reflection, diffraction and interference, with a variety of materials including cellophane and adhesive tape. Various embodiments include kits for showing and teaching how to create art with layered cellophane and/or adhesive tape, pre-cut cellophane or tape to specific sizes and shapes to ease folding or application for the specific function of using cellophane as optical origami or adhesive tape art, kits with tools provided to shape adhesive tape by cutting, punching out, or carving out specific shapes from tape to overlap them in various ways to create art and learn the optical effects of diffraction and interference, kits using knitting and stitching of photo elastic fibers, and kits using photoelastic objects, models made from orgami cellophane or tape for puppeteering. In one kit, two precut cellophane shapes are includes, 2.5" square and 4" square, for folding into various shapes. All of these items are novel.

Embodiments of the invention include kits with tools and instructions where the customer makes the art themselves, rather than art being sold pre-made, and use of reflection from a mirrored or glossy surface rather than merely transmission in which light also undergoes partial reflection and diffraction through the layers of cellophane. No previous products have provided toys for children or tools, instructions, or materials for the customer to create their own art and to view their creations interchangeably with a simple polariscope. No previous products have provided origami cellophane cut to specific size and shapes to make possible the folding of the cellophane not just to create regular models but to create them for their optical effect.

In order to view the optical effects of photoelastic puppets or other objects, cellophane origami or adhesive tape art, polarizing films are necessary. Polarizing films can be incorporated into glasses for ease of use. In certain embodiments cardboard polarizing glasses not only have polarizing film but also have a diffraction grating behind the polarizing film of the glasses. This intensifies the color display of a photoelastic model between the polarizing film that the model is in front of and the polarizing film of the glasses.

In some embodiments, a polarizing lens is held in a round frame (other shapes can be used in certain embodiments), which may display text and/or graphics to enhance ease of use and/or entertainment value, and the combination is termed a portal, magic portal, or portal ring. A stand for holding the lens in its frame can also be considered part of the portal or magic portal in some embodiments. To view objects under polarized light, the object can be placed between two portals, or in front of a portal while a viewer wears polarizing glasses, or a polarized light source can be used with a portal or polarizing glasses.

Instead of a polarizing film behind the photoelastic model (or other object), a polarizing light source can be placed behind the model. This polarizing light source in some embodiments is a polarizing light bulb or a light source where the polarizing film is incorporated into the light for the purpose of viewing origami cellophane, adhesive tape art, and photoelastic/photoplastic puppets.

In some embodiments, adhesive tape and/or adhesive cellophane is processed for easy tearing or removal of specific shapes of cello/tape pieces for creating optical art with the cello/tape pieces by overlapping them in a variety of configurations. In other embodiments, the tape and/or cellophane is unprocessed and must be cut by the user.

Creating and using photoelastic models and other objects with optical effects such as cellophane origami does require skill for achieving the best possible effects. With skill, not only do the models have a superior appearance, but by skilled manipulation the models can actually be given the appearance of life. For example, the butterfly can be made to appear to be gracefully flying and the dragon can look like it is snorting, etc. Instructions can aid in reproducing these effects. Manipulation of the puppet model deforms the shape of the puppet in both its overall shape and the optical effects produced, with the manipulation and new combination bringing life to the model. This can further be enhanced with sound effects, music, and story telling.

Figure 17:
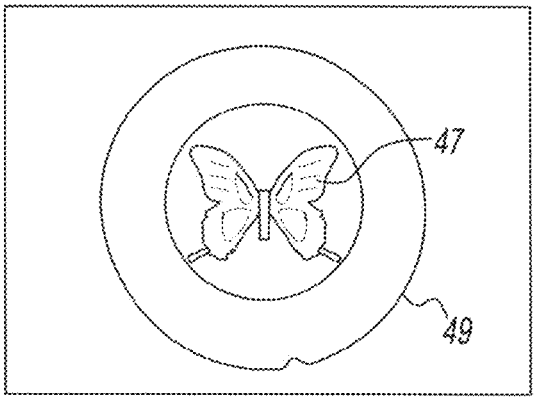
FIG. 17 shows a photoelastic butterfly model fixed to a polarizing film and held up to the sky, which provides a polarized light source and reveals the optical effects of the model.
Figure 18:
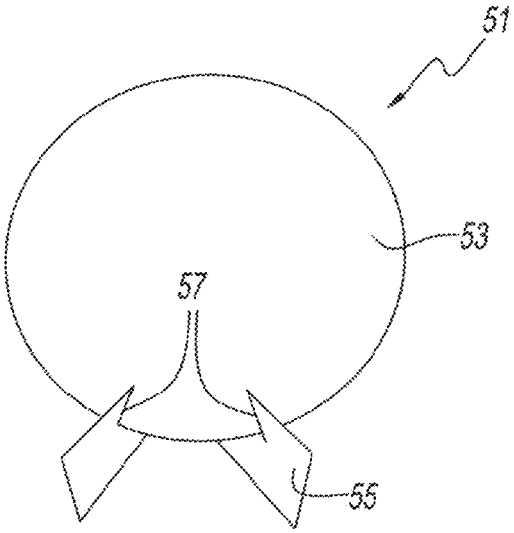
FIG. 18-22 show a simple design of an ergonomic polariscope.
Figure 19:
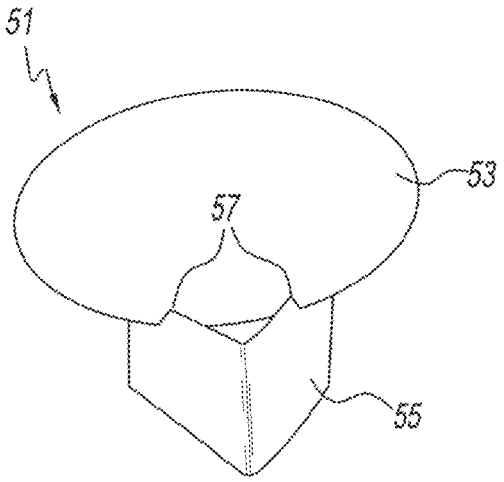
Figure 20:
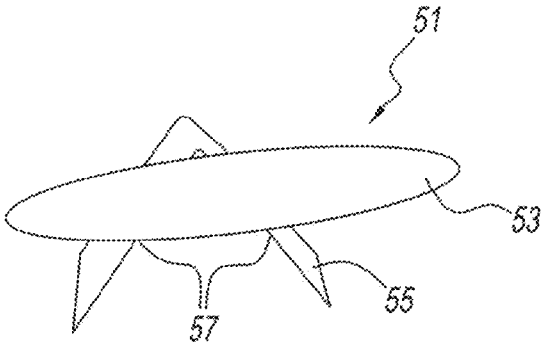
Figure 21:
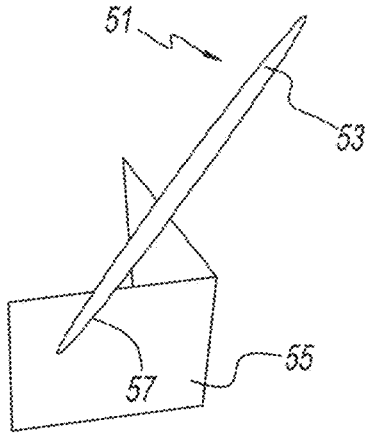
Figure 22:
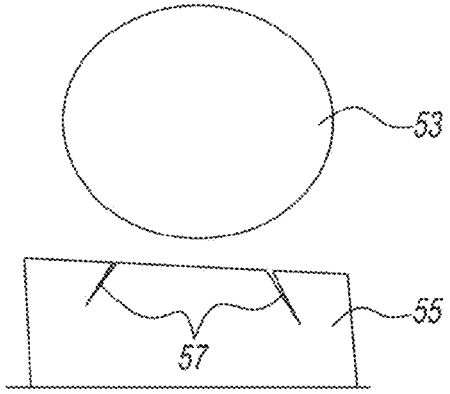

Photoelastic puppets in some embodiments are created in such a way that they are edible and intended to be eaten. The puppets in some embodiments are stuck on the polarizing film rings, as shown in FIG. 17, showing a butterfly sent and operated in front of the sky, and FIG. 38. In some embodiments sheets of overlapping tape art or origami folded art are hung above or over an upright polarizing film and viewed through another upright polarizing film or through polarizing glasses. They of course can also be viewed on a film supported over a light source in a horizontal position through another horizontal film above or through polarizing glasses.

Users of puppet kits can make up their own stories and create their own puppets and puppet shows. In some embodiments, already crafted puppets are included with photoelastic models set to a story line with music, such as Peter and the Wolf. In some embodiments there are molds for making models of many different kinds of characters and things, both that are not intended to be eaten and those that are edible and intended to be eaten.

In some embodiments a light source with or without polarizing film is placed in an insert in a book as well as photo elastic/plastic transparent/translucent plastic models. These models and other optical materials can glow in the dark as well and come in a variety of colors. The purpose of the light source is to provide viewing of photoelastic/photoplastic models provided or found around the home. If the light source does not have polarising film incorporated within it, film in some embodiments is attached over the light permanently and the light turned on with a switch, or attached in a way that it can be removed and then replaced so that it can even be rotated to view a Kaleidescope effect in photoelastic or photoplastic models. The polarizing film in some embodiments is held in place over the light within the insert by sliding clips fixed within the board of the insert of the book. Three or four clips for example can slide over the border of polarizing film, holding it in place, and then be moved away to remove the film.

In some embodiments polarizing glasses or additional polarizing films, diffraction glasses or films separate or attached or attachable to the polarizing films/glasses, and/or other optical supplies and effects also come with the book. Black glossy cardboard or other reflective surfaces with or without polarizing film over it are a page or insert within the book in some embodiments.

Liquid polarizing crystals can be manipulated electronically so that the direction of polarization of light from the screen can be controlled and varied over the whole or part of the screen. The direction of polarization of light from the screen can be made to rotate with respect to another polarizing film or polarizing glasses controlling the transmission of light seen by a user through the screen and the second film. If optical art with cellophane or adhesive tape or photoelastic/photoplastic models are placed between a polarizing film or polarizing glasses and the screen in which the direction of polarization of light emitted from it is rotating then a Kaleidescope effect can be created. The optical effects can also be varied by manipulating the thickness, processing, and chemical composition of cellophane, tapes and plastics used in various embodiments to create the art with cellophane, tape, and photoelastic/photoplastic models.

Various embodiments include origami cellophane, tape, optical art kits and optical puppets. Cellophane can be precut in a variety of shapes for special folding for optical effects and not just regular square shapes. It can be precut in finished designs such as geometric shapes, animals, plants, fantasy creatures, letters, etc., or it can be precut into shapes that facilitate folding into a final finished design or a variety of such designs. Adhesive cellophane/tape can be precut to peel off shapes of any sort for overlapping art from a board backing. Tape rolls can have precut shapes of all kinds that can be peeled off for overlapping tape art. Irridescent or luminescent paints, oils and other additives with supplies/tools (brushes/droppers) can be provided. Cellophane of different colors and optical effects can be used. Puppets in some embodiments use origami, cellophane, tape, and photoelastic/photoplastic/glow in the dark objects.

FIG. 1 is a diagram illustrating transparent or translucent Cellophane cut into specific dimensions for the purpose of creating origami models by folding that show optical effects by diffraction and interference when viewed under polarized light. Origami cellophane can be precut into a variety of shapes in order to create an infinite number of folding patterns, not just to create a specific folded structure, but a structure designed to create an optical effect based on how the layers of the cellophane overlap in folding.

Possible precut cellophane shapes 1-10 include squares 1, circles 2, hexagons 3, triangles 4, diamonds 5, ellipsoids 6, stars 8, horns 7, and bowties 9. Shapes 9, 10 show how two precut cellophane models can be combined by overlap, twisting or folding together. Two precut cellophane pieces are twisted/folded together at point 11 and the models can be still folded for more optical effects 12. The folded models can be held in place by a transparent or translucent plate, film, or other suitable fixation. Any kind of shape can be cut or precut including all geometric shapes, animal (including human), plant, fantasy shapes, letters, symbols, celestial shapes, building, cars, planes, trucks, bicycles, heart shapes, shapes of clouds, candy canes, faces, parts of plants and animals or fantasy shapes and many other shapes.

Figure 2:
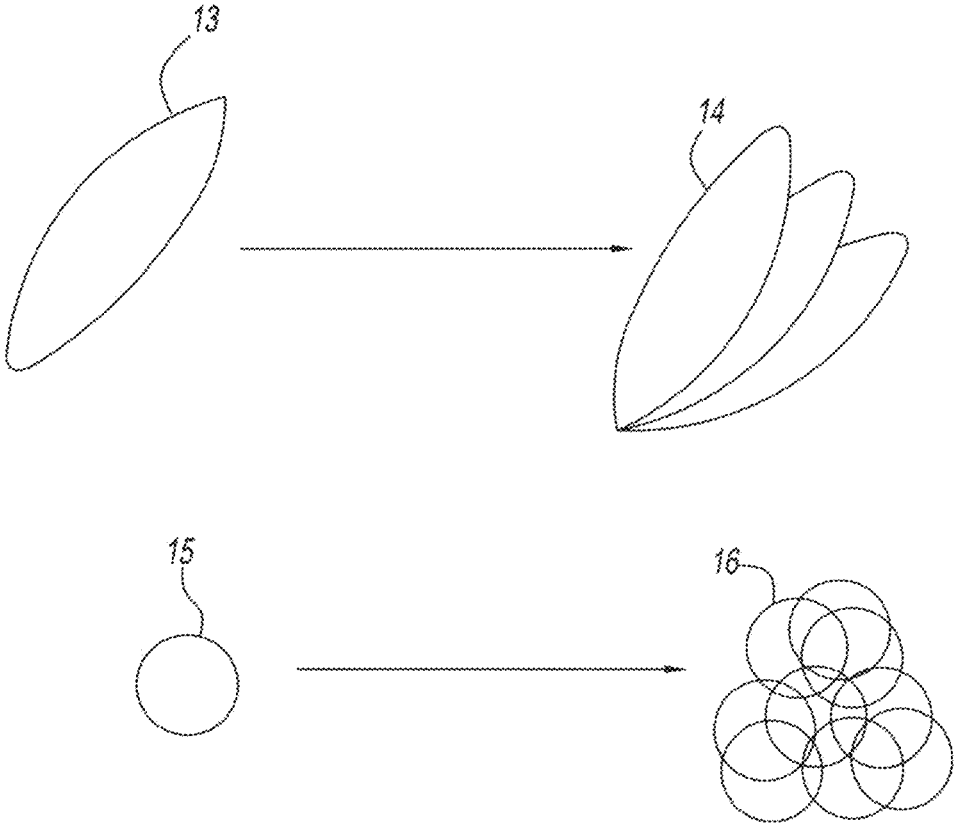
FIG. 2 shows transparent or translucent adhesive cellophane or tape cut with tools or precut into shapes for placing in an overlapping manner.

FIG. 2 shows transparent or translucent adhesive cellophane or tape cut with tools or precut into shapes 13, 15 that can be removed and placed on transparent or translucent cellophane or other suitable surface in an overlapping manner 14, 16 in order to create optical effects by diffraction or interference. Any kind of shape can be cut or precut including all geometric shapes, animal (including human), plant, fantasy shapes, letters, symbols, celestial shapes, building, cars, planes, trucks, bicycles, heart shapes, shapes of clouds, candy canes, faces, parts of plants and animals or fantasy shapes and many other shapes.

Figure 3:
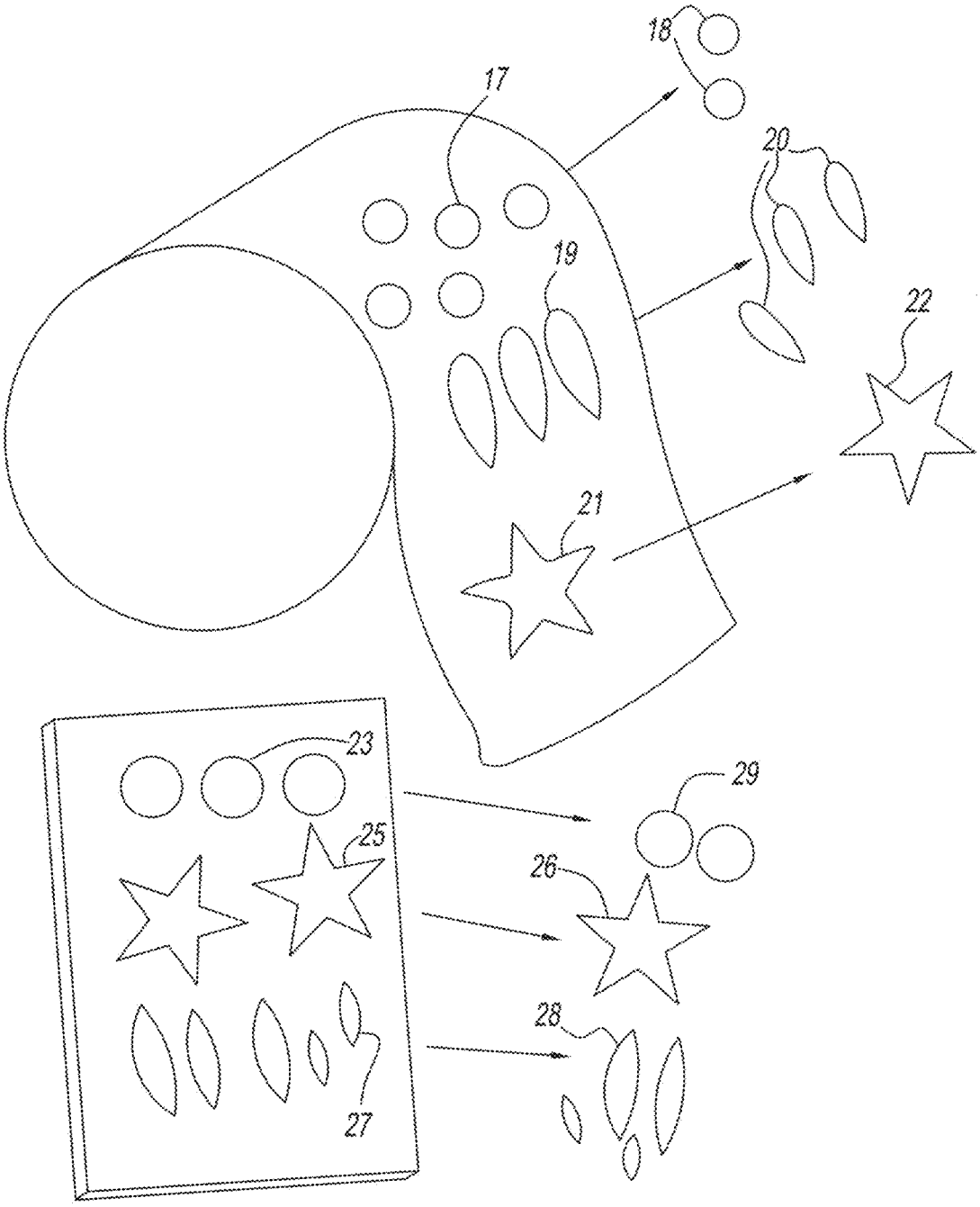
FIG. 3 is a diagram showing adhesive cellophane or tape shapes that can be peeled to create overlapping optical art.

FIG. 3 is a diagram showing adhesive cellophane or tape shapes 17-28 that can be peeled off a tape dispenser 17-22, sheet or board 23-28 for easy and ready use to create overlapping optical art. Shapes 17-28 are examples of shapes that are precut and peeled off. However, any kind of shape can be cut or precut including all geometric shapes, animal (including human), plant, fantasy shapes, letters, symbols, celestial shapes, building, cars, planes, trucks, bicycles, heart shapes, shapes of clouds, candy canes, faces, parts of plants and animals or fantasy shapes and many other shapes.

Figure 4:
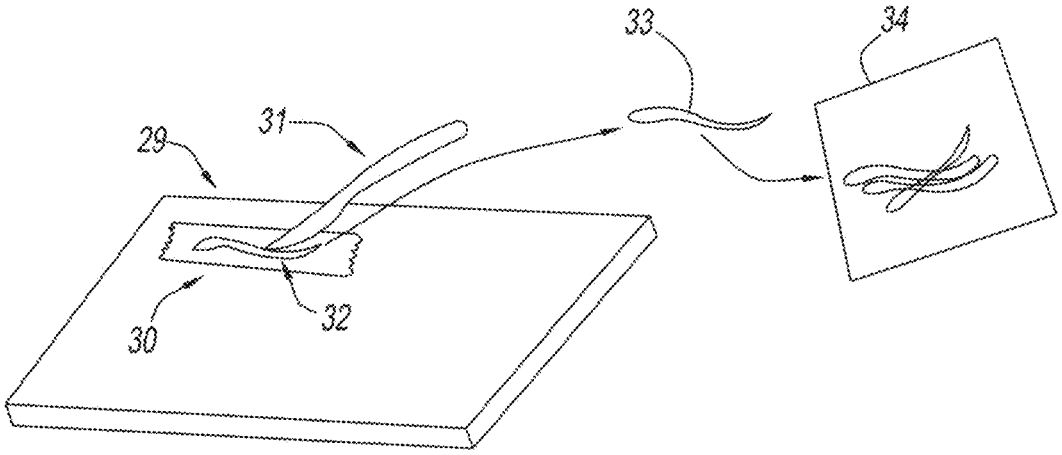
FIG. 4 is a diagram showing how a user can place adhesive tape or cellophane on a cutting surface.

FIG. 4 is a diagram showing how a user can place adhesive tape or cellophane on a cutting surface provided with a kit or instructed in the kit to obtain. Adhesive tape 30 is placed on the cutting surface 29. The user may then use carving device 31 to carve out suggested shapes or any shape the user might desire 32, and peel off the shape 33 and then place it on another surface with other shapes 34 in an overlapping manner to create the optical art.

Figure 5:
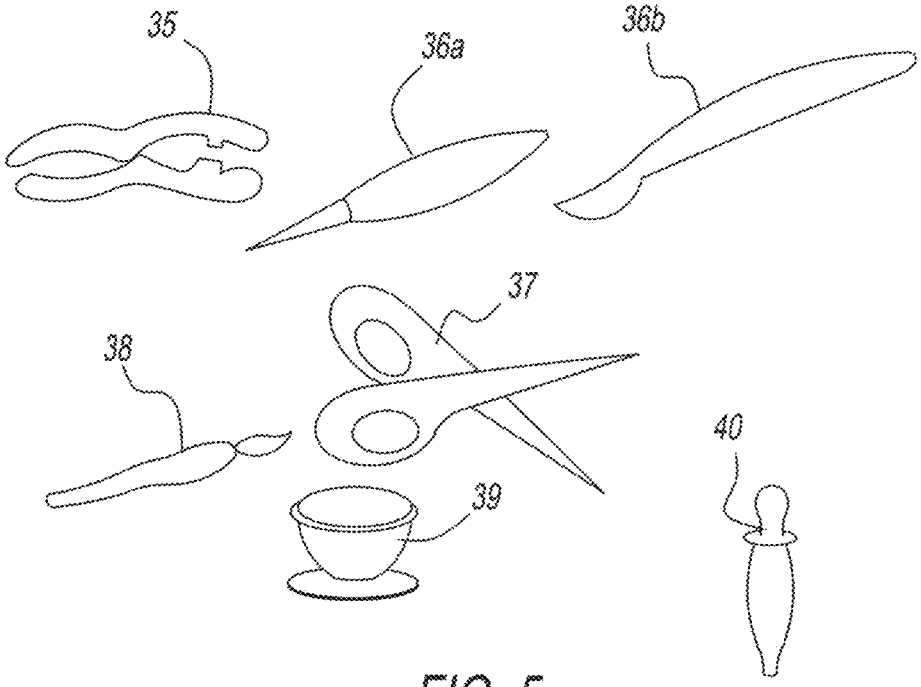
FIG. 5 shows examples of tools that can be used with kits for origami and adhesive tape art.

FIG. 5 shows examples of tools that can be used with kits for origami and adhesive tape art. Punch tool 35 is an example for punching out a shape from adhesive or non-adhesive tape or cellophane and the shape punched out can be any shape. Tools 36*a* and 36*b* are carving tools, one an awl with a point 36*a* and another a carving knife with a blade 36*b*. Scissors 37 are very useful, brush 38 can be used to paint on other optical effects, colors, oil, glitter, glow in the dark films and many other things including more adhesive, which can be held in container 39. Dropper 40 is used to apply material to create optical effects or more adhesive.

Figure 6:
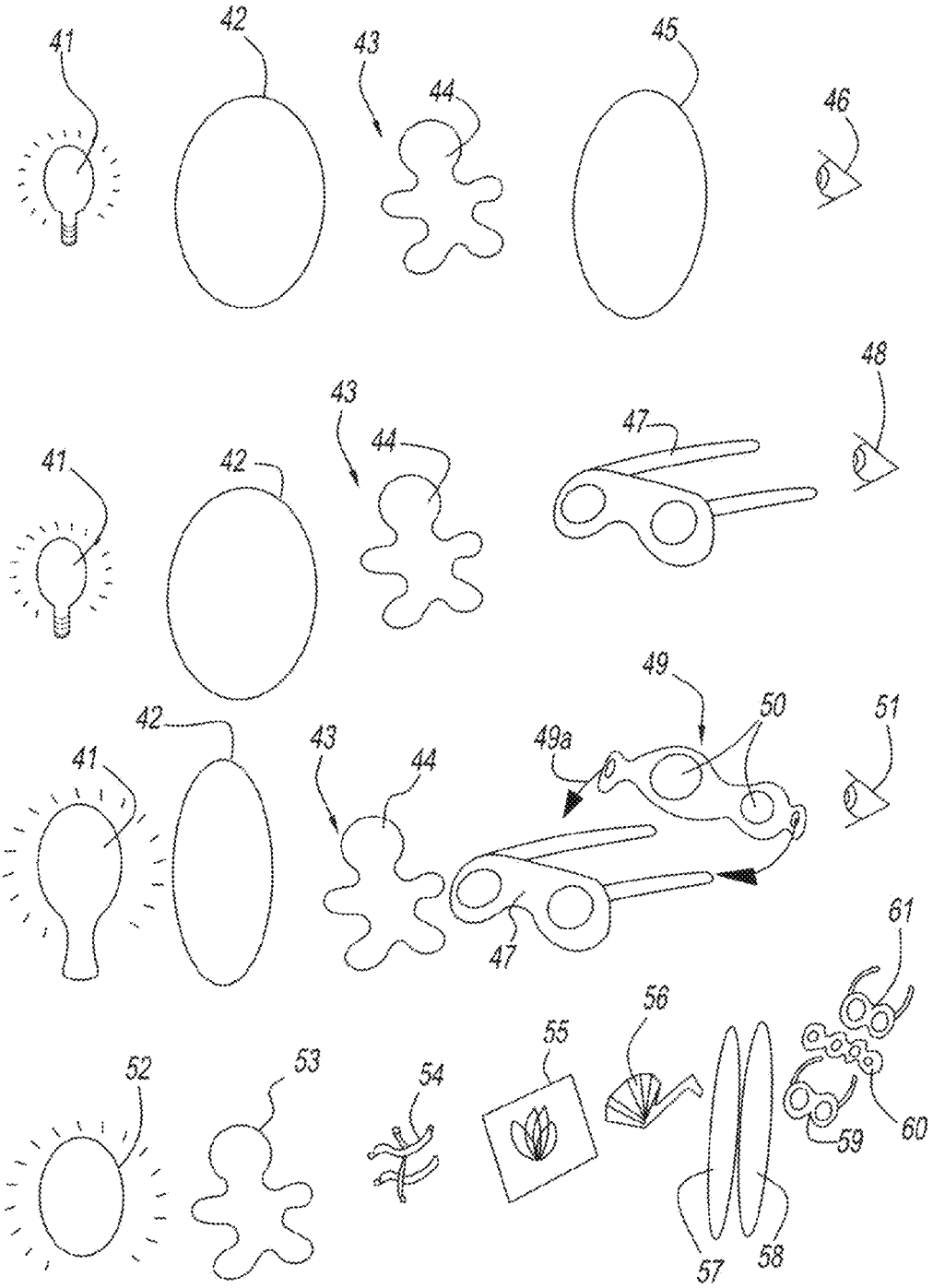
FIG. 6 shows many ways to have optical puppets.

FIG. 6 shows many ways to have optical puppets. Light source 41 can be ambient light, an incandescent, LED light, candle or other light source. Polarizing films 42, 45 polarize passing light. Object 44 is a photoelastic/photoplastic object or model made with origami cellophane, tape, or photoelastic fibers that can be manipulated with hands, strings, clamps, motors, springs or other device to make the object come to life suggestive of a character in a story. This can be set to music to enhance the effect. Polarizing films 42, 45 can be rotated with respect to one another in order to create a kaleidoscope effect manually or by a motor or other device. Object 44 is viewed by viewer 46. Alternatively, it can also be projected onto a screen or wall.

Polarizing glasses 47 can be used in place of polarizing film 45. The film in the polarizing glasses can be oriented 90 degrees with respect to polarizing film 42 in a marked position in order to help the user to determine the crossed polarizing position of the glasses with respect to the film. User 48 wears the glasses. Pair of glasses 49 without arms has diffraction lenses 50 and holes at the side 49*a* so that it can slide over the arms of glasses 47. Light source 52 is a polarized light source, for example a light source with polarizing film incorporated into it, the blue sky, a TV screen, or a computer screen. Examples of optical puppets 53-56 can be photoelastic or photoplastic models 53, tape or cellophane models 55, 56, and/or knitted models 54. Polarizing film 57 can have an accompanying diffraction film 58 or be used with polarizing glasses 59 or polarizing glasses with slide on diffraction lens 59 and 60 or a pair of specially made polarizing glasses that also has the diffractions lens attached behind the polarizing lens 61. Diffraction lens can have a variety of patterns including patterns that enhance story telling with special images produced in conjunction with the models.

Figure 7:
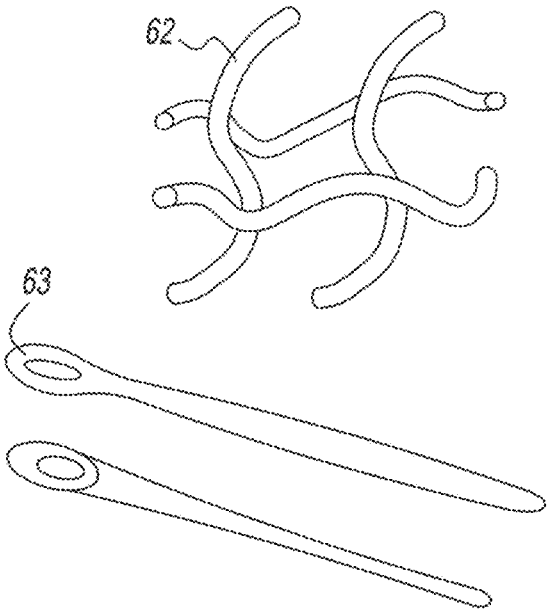
FIG. 7 shows the weaving of stretchable fibers made of elastic photoelastic material.

FIG. 7 shows the basic idea of weaving stretchable fibers made of elastic photoelastic material such as polyurethane 62 with tools like weaving needles 63. Thin photoelastic stretchable fibers are knitted together to create any number of models of various shapes and designs in the same way that knitted creations are made with standard yarn.

Figure 8:
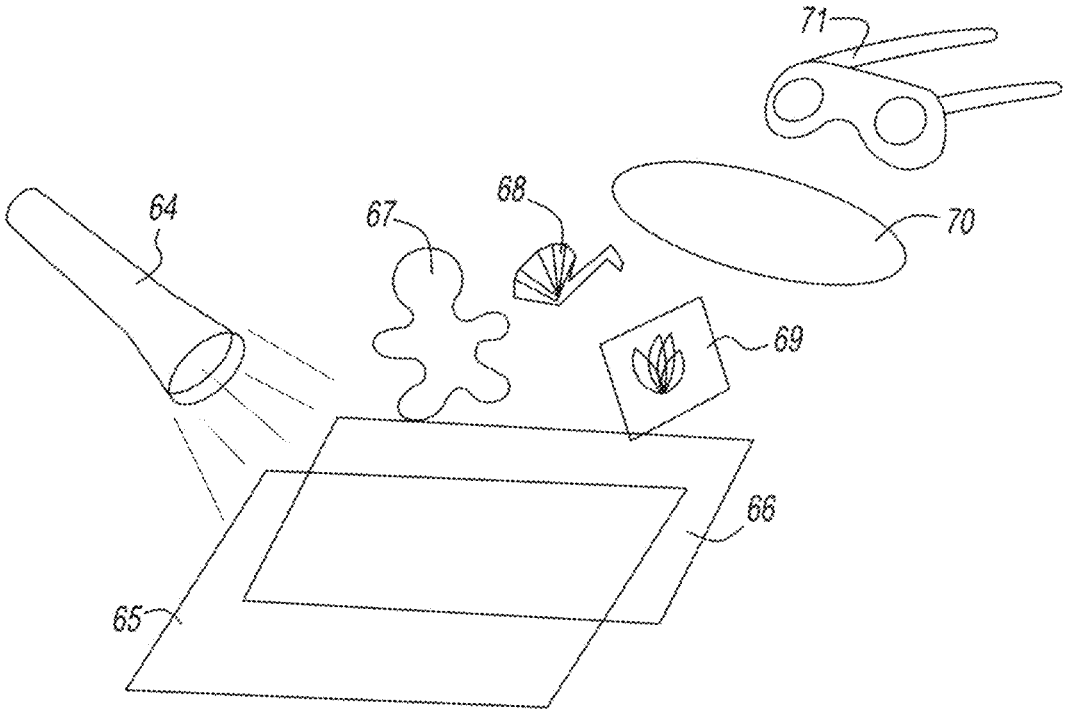
FIG. 8 shows the effects demonstrated in FIGS. 1-7 using reflection rather then transmission.

FIG. 8 shows the effects demonstrated in FIGS. 1-7 using reflection rather then transmission. Light source 64 can also be ambient light shines on reflective surface 65, which may be a mirror that is for example metal, glass, plexyglass, cardboard of any color or black glossy cardboard, which may or may not have polarizing film 66 over it. Optical puppets made of photoelastic/plastic objects, tape, cellophane or art made of cellophane or tape 67-69 can be viewed through polarizing film 70 or glasses 71 that can be enhanced with diffraction film or glasses as detailed before.

Figure 9:
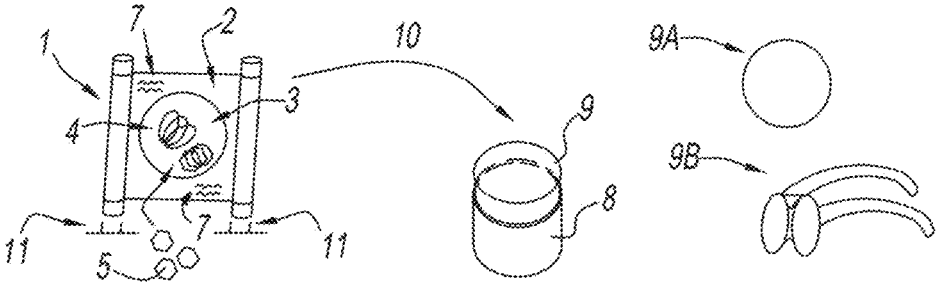
FIG. 9 is a diagram of an optical scroll.

FIG. 9 is a diagram of an optical scroll 1 consisting of two stick shaped objects around which a sheet 2 of cellophane, paper, foil, reflective material, cloth or other material is wrapped around the stick objects so that it can be rolled and unrolled as the need arises. Area 3 allows for special effects such as a hole where transparent or translucent cellophane or other material can be placed. Other possibilities include reflective material, polarizing film, diffraction film or even photoelastic or photoplastic material. Tape art or other optical art 4 is on the surface of the material placed in the hole of area 3 for optical effects. Precut tape art, origami cellophane supplies or other supplies 5 allow a user to create their own art within area 3. Precut tape is placed 6 with area 3 to make optical art designs. The scroll or scrolls can have writing 7 that tells a story.

A light source 8 can be provided that can be in a horizontal or upright position to use with the scroll/scrolls. A polarizing film 9 can be supported over or in front of the light or a part of the light itself. Ambient light with a polarizing film or the polarizing effects of the blue sky can also be used. A second polarizing film 9A can be laid over or propped up in front of the scroll that is itself over or in front of polarized light or has polarizing film placed within it. The second polarizing film 9B can be in the form of polarizing glasses. The scrolls and glasses can be made so that the polarizing films used will be at 90 degrees when oriented at a specific position indicated by notching or other type of mark. Arrow 10 shows that the scroll can be placed over the polarized light source. Arrow 11 shows that the scrolls can be propped up on a stand.

Figure 10:
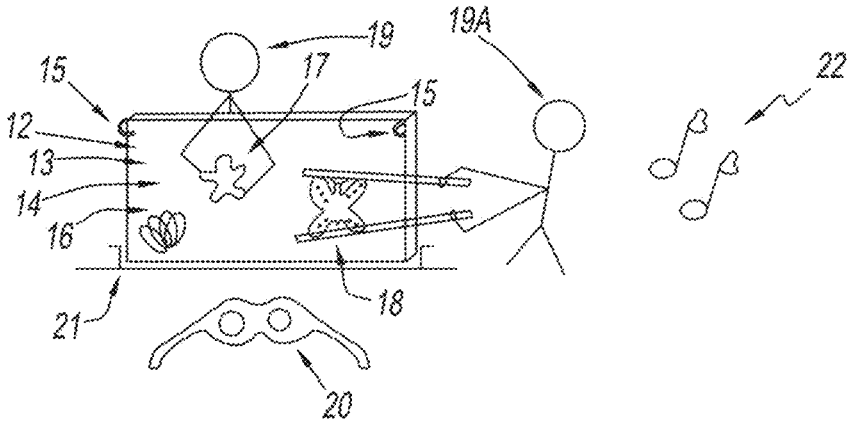
FIG. 10 is a diagram illustrating an optical puppet show.

FIG. 10 is a diagram illustrating an optical puppet show and showing the design of puppet show kits for photoelastic/photoplastic objects, origami cellophane and tape that can be premade or created by the user with instructions and some precut material, all of which can be made to serve as puppets, show props, and scenic displays. Light source 12 can stand vertically or be used horizontally or any other position. Light source 12 can be ambient light with a propped up polarizing film 13 or a polarizing film 13 that is part of the light source or in front of the light source. The polarizing light source can also be a TV or computer screen.

Additional coverings 14 such as transparent or translucent cellophane are shown on which tape or origami cellophane has been applied or can be applied with materials/instructions supplied to the user for the purpose of creating optical art for scenes, props, etc. for a puppet play story. Clamps/hooks or other device 15 hold objects such as covering 14 or other objects in place. Photoplastic/photoelastic objects can also be held in place.

Example of tape art 16 is done previously or by the user with supplies and instructions as part of a prop, scenic feature, or fixed image for the story of a puppet show. Photoelastic/photoplastic, origami cellophane, tape art, or combination thereof makes a puppet 17 that is being manipulated by a user 19 by hand. Photoelastic/photoplastic, origami cellophane, tape art, or combination thereof makes a puppet 18 supported by sticks that is being manipulated by user 19A. Puppets can be fixed in a variety of ways including strings, screws, springs, hooks, clamps or even motorized methods. They can be fixed inside rings that are in turn attached to strings, screws, hooks, clamps, or motorized methods. User 19 manipulates puppets by hand as described above. User 19A manipulates puppets with other supports as described above. Viewers can enjoy a puppet show with polarizing glasses 20 or with another propped up polarizing film in front of the puppets that are manipulated. All can also be enhanced with diffraction glasses and/or with diffraction lens that fit on the polarizing glasses.

A stand 21 can be made to position the light in an upright or other position. Music and stories 22 can be provided with the optical puppet kits. Music that goes with the character of the puppets such as in Peter and the Wolf can be created. The user can create their own stories and/or music. Lessons on creating music and stories to go with the optical art puppet show can be provided.

Figure 11:
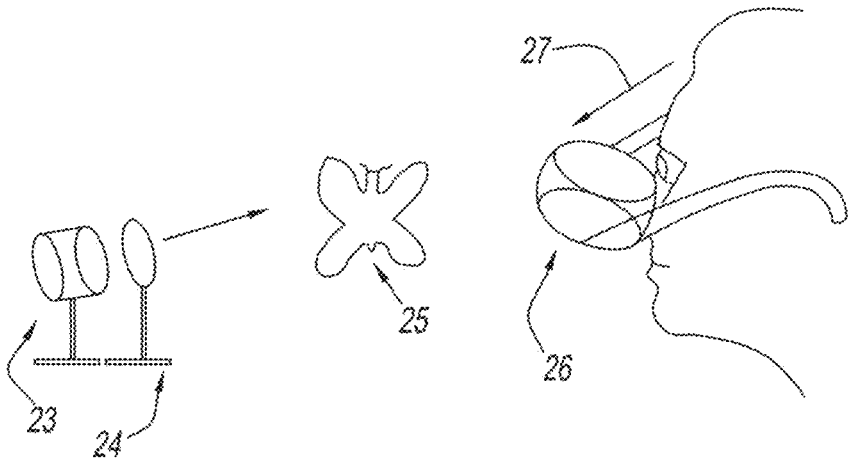
FIG. 11 is a diagram illustrating an ergonomic polariscope.

FIG. 11 is a diagram illustrating an ergonomic polariscope that can be angled for a comfortable position for viewing optical art (tape and origami cellophane) and photoelastic/photoplastic toy objects. Light source 23 with or without polarizing film as a part of it is supported by a stand that allows the light to be positioned in the most comfortable position. A stand can also be created in a fixed position that is angled for a comfortable position. One or more polarizing films or other optical films (such as diffraction films) 24 can also be on a stand that can be manipulated into or is fixed in a position for comfortable viewing. Example of optical art 25 (origami cellophane, tape art, photoelastic/photoplastic objects, and combinations) can also be manipulated by hand, propped up on a stand that also is positioned or allows for positioning for comfortable viewing. Polarizing glasses, diffraction glasses, or combination 26 is angled to allow for comfortable viewing of the optical art (origami cellophane, tape art, photoelastic/photoplastic objects, and combinations). Here the glasses are angled downward 27 for comfortable viewing given the positioning of the light, films, etc.

Figure 12:
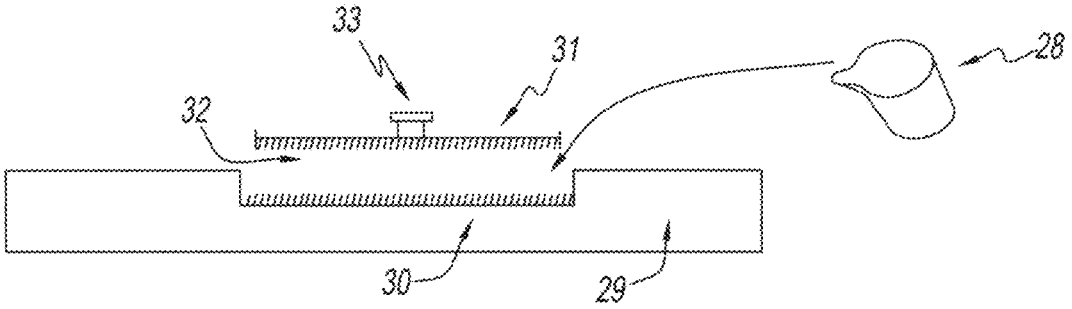
FIG. 12 is a diagram showing the production of candies or salty and other treats with a diffraction effect.

FIG. 12 is a diagram showing the production of candies or salty and other treats with a diffraction effect. This can be a kit with instructions, or pre-manufactured. A combination of dyes/colors/reflective surfaces/mirrors, and multiple combinations of colors can enhance the effect. Preparation 28 is intended to be eaten, such as plasticized sugar or another mixture, and is in a container for pouring. Preparation 28 is poured into mold 29. Fine grooves 30 in mold 29 create a diffraction pattern in poured mixture 28 after curing. Lid 31 can fit into mold 29 and make more impressions on preparation 28 after it has been poured into mold 29. Fine groves 32 in lid 31 create a diffraction pattern in poured mixture 28 after curing. Handle 33 on lid 31 allows for manipulation of lid 31.

Figure 13:
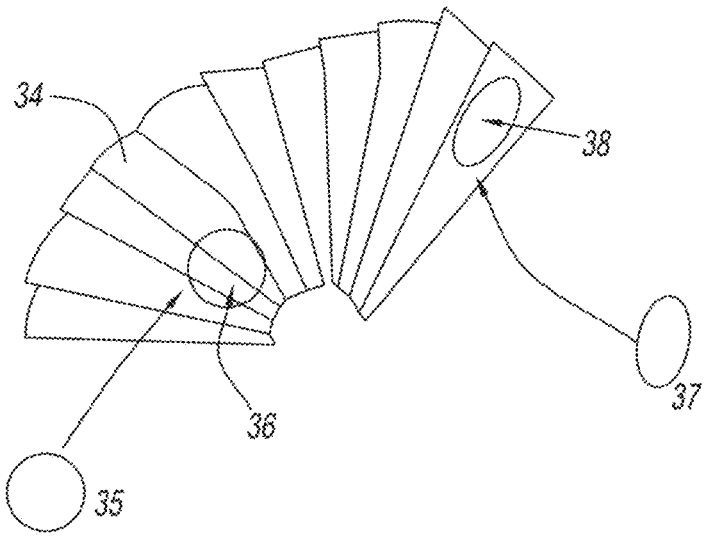
FIG. 13 is a diagram illustrating combination origami and tape art.

FIG. 13 is a diagram illustrating combination origami and tape art. Example of folded origami cellophane 34 can be combined with precut tape 35. Precut tape design 36 is placed on folded origami cellophane 34 to both enhance the optical effects of origami cellophane 34 and to hold origami cellophane 34 in place. Precut tape design 37 is used in combination with origami cellophane 34. Precut tape 37 is placed over origami cellophane 34 as in demonstration 38 in order to create more optical effects by means of reflection/diffraction. Note that tape can be transparent/colored/translucent/opaque/mirrored on its surface or glow in the dark. The combination of origami cellophane can also include cellophane and tape that is transparent/colored/translucent/opaque/mirrored on its surface or glows in the dark.

Figure 14:
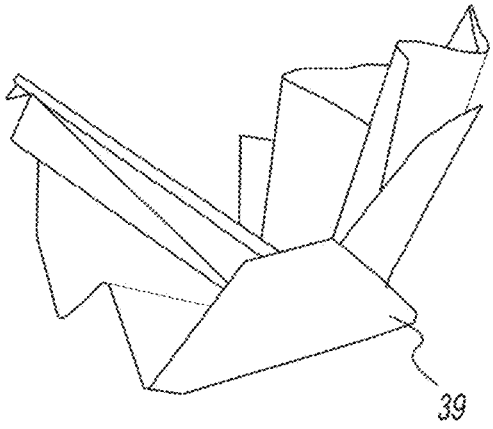
FIG. 14 shows an origami cellophane model with optical effects created by the folds of cellophane.
Figure 15:
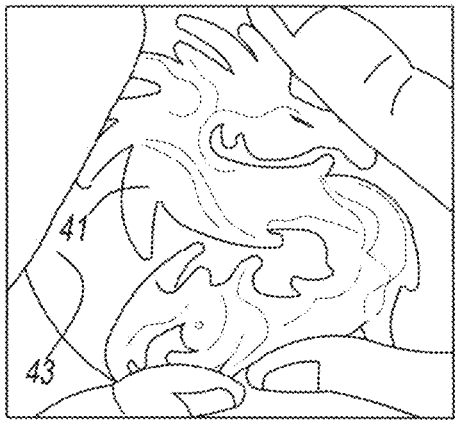
FIG. 15 shows a photoelastic dragon model and the optical effects created when it is manipulated between polarizing films.
Figure 16:
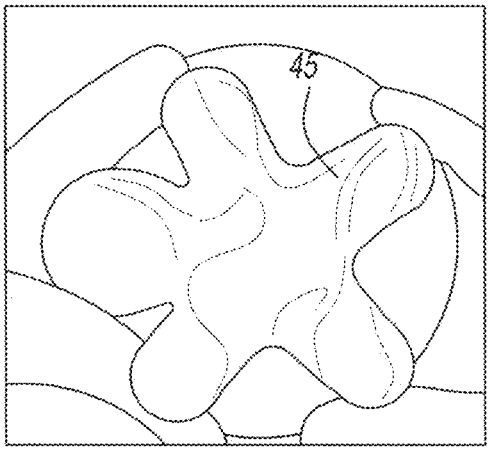
FIG. 16 shows an abstract human photoelastic model manipulated between polarizing films.

FIG. 14 shows an origami cellophane model 39 with optical effects created by the folds of cellophane. FIG. 15 shows a photoelastic dragon model 41 and the optical effects created when it is manipulated between polarizing films 43. FIG. 16 shows an abstract human photoelastic model 45 manipulated between polarizing films. FIG. 17 shows a photoelastic butterfly model 47 fixed to a polarizing film 43 and held up to the sky 49, which provides a polarized light source and reveals the optical effects of the model.

FIG. 18-22 show a simple design of an ergonomic polariscope 51. The yellow circle 53 represents the polarizing film within a round frame and indicates how the portal films are set in an inclined position. The base 55 has angled slits 57 to insert the round frame with the film 53 into the base 55, positioning it in an inclined position for greater comfort when viewing through it. Two aligned portals can involve one with a higher base in relation to the other so that the two portals are properly aligned with respect to one another for the viewer, or a single portal can be used with polarizing glasses. The frame and base can be a cardboard design or made from any kind of material.

Figure 23:
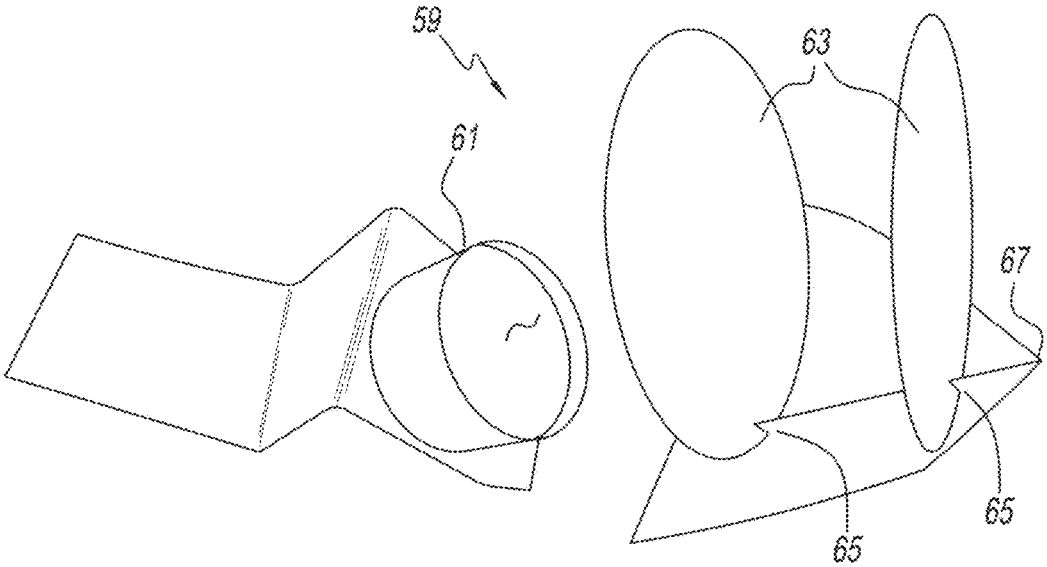
FIGS. 23 and 24 show an embodiment of an ergonomic polariscope.
Figure 24:
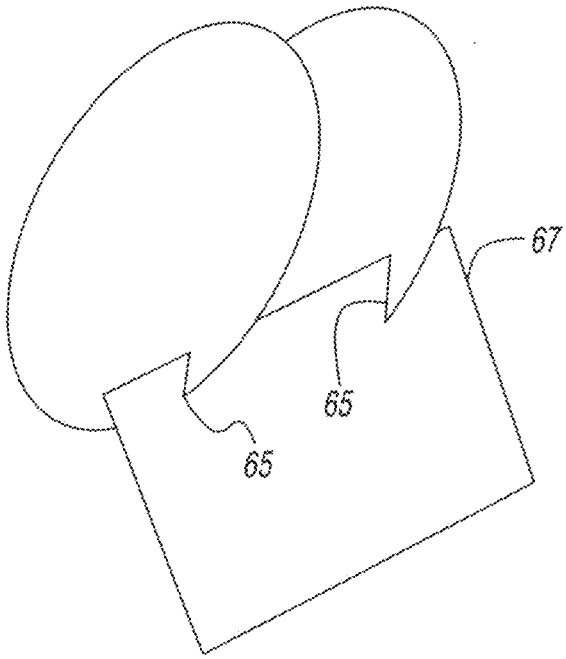
Figure 25:
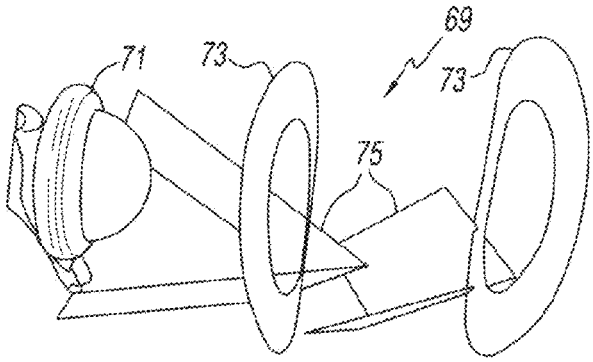
FIGS. 25-30 show an embodiment of an ergonomic polariscope.
Figure 26:
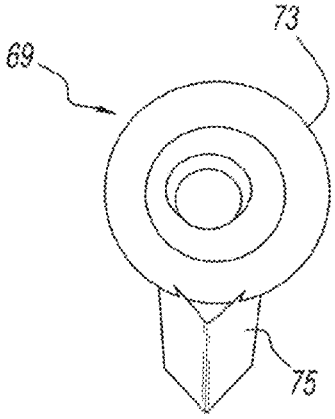
Figure 27:
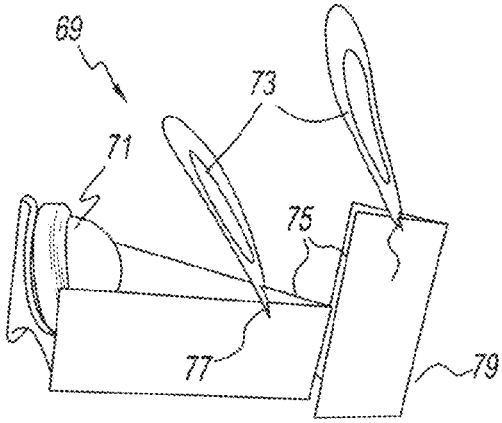
Figure 28:
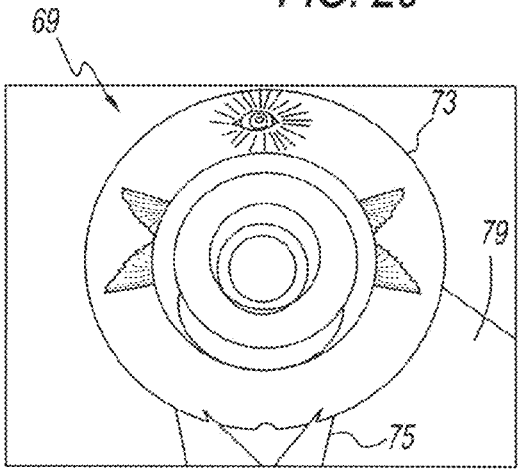

FIGS. 23 and 24 show another embodiment of an ergonomic polariscope 59, which in various embodiments is made with cardboard or any other material (wood, plastic, metal, etc.). A version made with cardboard or a similarly flexible material is very versatile and able to be folded in a variety of ways. In this configuration a light 61 can be supported at an angle and the polarizing films 63 or other optical films, art, etc. also inserted at an angle. Note that as the point of the fold 67 in the base 55 is approached, the insert slit 65 is less deep so that the front ring 63 of film or art stands up the highest, creating a comfortable overall viewing angle.

Ergonomic polariscopes are used with or without polarizing glasses, which can also have an ergonomic design in which the rim of the glasses that go around the user's ears attach to the lens on the bottom of the frame of the glasses that is angled forward.

Figure 29:
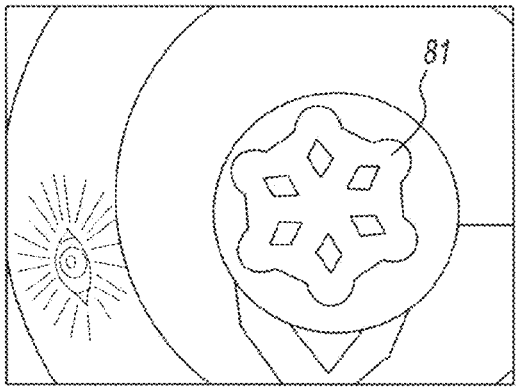
Figure 30:
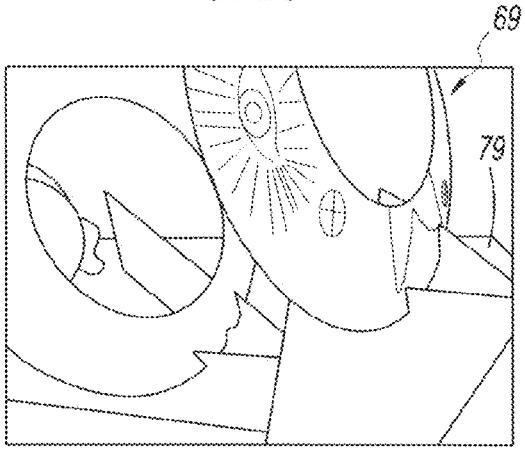
Figure 31:
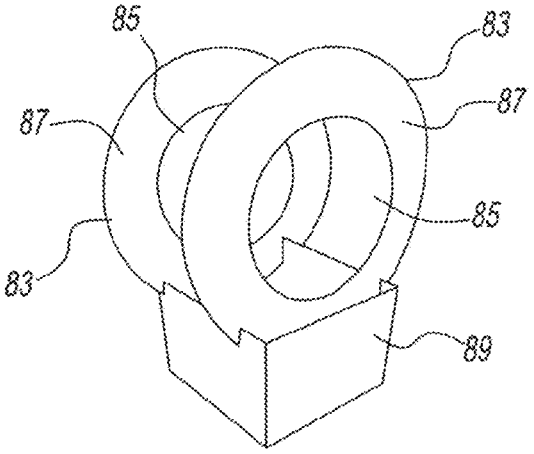
FIGS. 31-42 show a cardboard toy polariscope.

FIGS. 25-30 show another embodiment of an ergonomic polariscope 69. The slanted slits 77 in the base 75 allow for an angling of the films 73 so that viewing is more comfortable compared to leaning all the way over a horizontal display or leaning one's head back for a vertical display. A light source 71 is supported in a suitable position for transmission through the lenses 73. With the ergonomic polariscope, the polariscope can be positioned on a surface 79 such as a desk or table and viewed by a user in a natural seated position in front of the surface, without awkward body positioning or craning of the neck and without the user having to hold the polariscope. This allows for easy, natural, comfortable manipulation and viewing of the polariscope. This is done with cardboard or with a plastic/metal or other material, or hinged arrangement that allows the user to adjust the angle instead of having fixed angles as with slits in cardboard. In some embodiments the cardboard is designed to have a selection of slits, however. FIG. 29 shows a photoelastic model 81 held between the lenses for observation of optical effects therein using the polarized light.

In various embodiments, depending on the age and height of the user and positioning of the polariscope items, the slant angle ranges from 75 degrees from the horizontal line measured from the front of the polariscope (105 degrees measured from behind) for the most vertical setting, to 150 degrees from the horizontal line (30 degrees measured from behind) for the most horizontal setting. The angle of tilt of the lenses of glasses used in conjunction with such ergonomic polariscope fall in these same ranges. In certain embodiments with adjustable polariscope or glasses angles, the angle may be adjusted to any within these ranges.

Figure 32:
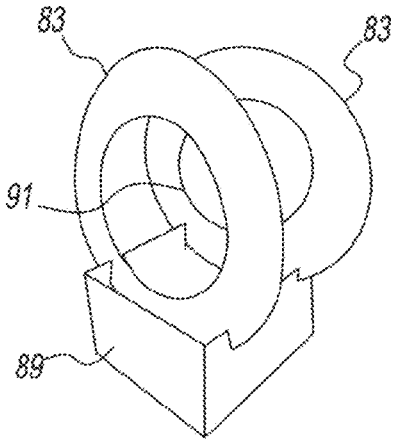
Figure 33:
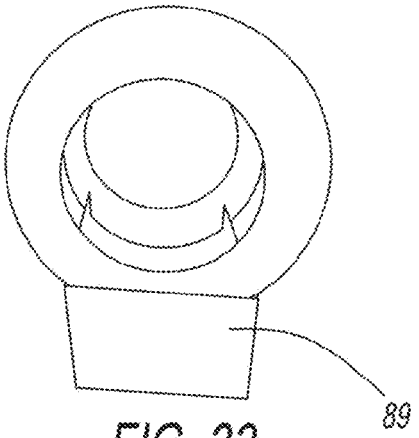
Figure 34:
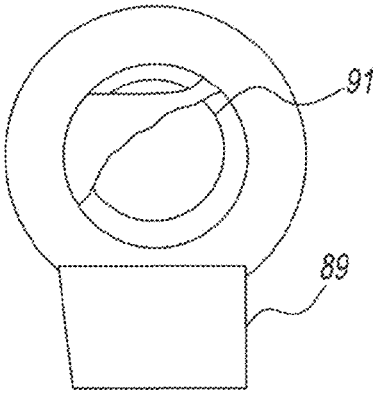
Figure 35:
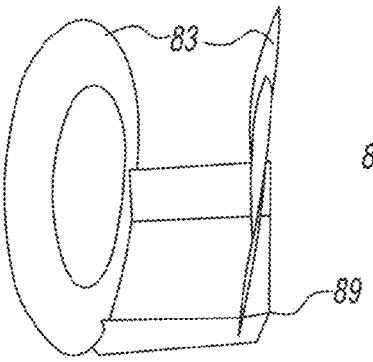

FIGS. 31-42 show a cardboard toy polariscope for viewing and manipulating e.g. photoelastic models. FIGS. 31-36 show the polariscope set up with front and back portals 83 (frames 87 holding polarizing films 85). FIGS. 32 and 34 show the portals aligned with one another such that transmission of light is blocked 91. Slits 93, 95 for insertion along the base 89 allow for versatility. The design allow for use of the polariscope with or without polarizing glasses and more.

As shown, the rings 83 can have different orientations with respect to one another, allowing more transmission of light or blocking light in the crossed position. A centrally placed slit 95 allows for placement of one portal symmetrically with respect to the base. When the two portals are placed there is plenty of room for hands to manipulate a photoelastic object in between the portals. Another cardboard item can even be mounted in between with the centrally placed slit 95.

Figure 42:
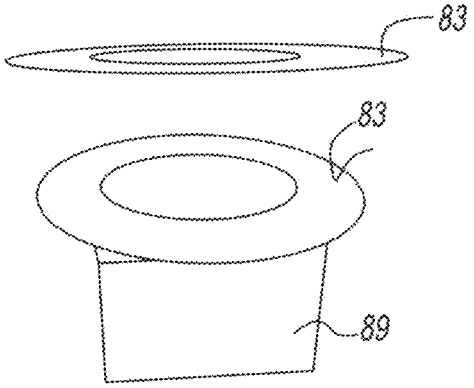

FIG. 42 shows one portal ring being held above the other in the horizontal position. Instead of being held, this top portal ring in one embodiment is supported with 3 or 4 springs that serve as additional mounts. The rings in one embodiment are inserted within the coils of 3 springs placed around the base, which encloses a light source.

Figure 36:
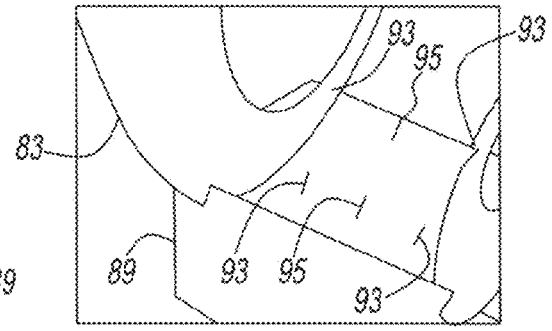
Figure 37:
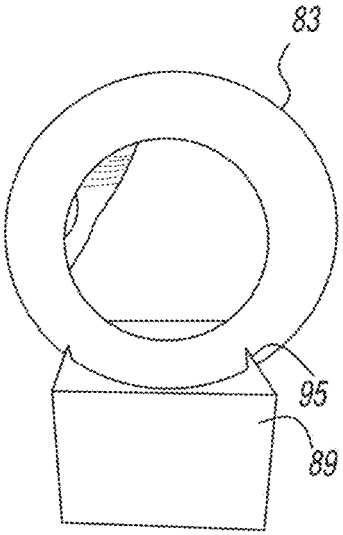
Figure 38:
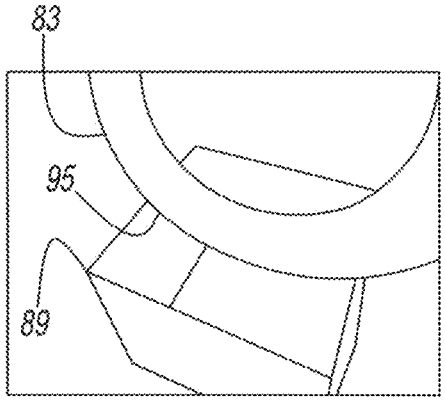
Figure 39:
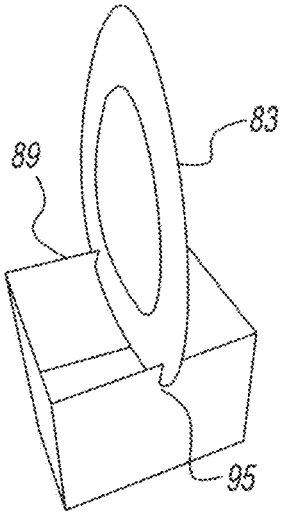
Figure 40:
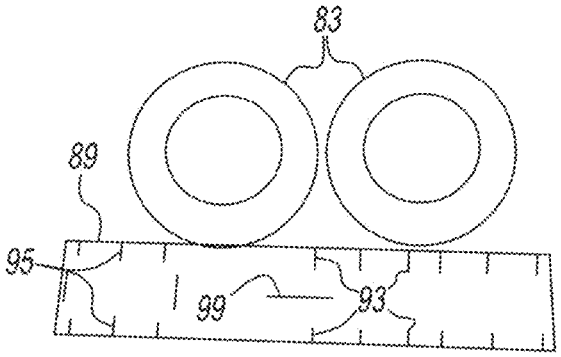
Figure 41:
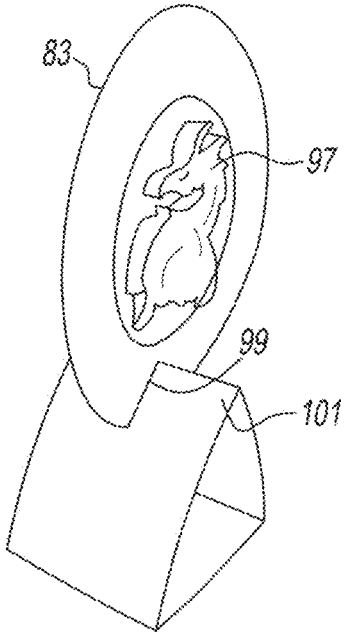

FIG. 36 for example shows the slits 93, 95 close up. The base 89 can also be folded into a triangular shape 101 to hold a portal in a vertical position in slit 99 as in FIG. 41. FIGS. 37-39 show a single portal inserted in the central slit 95 of the base. FIG. 40 shows the portals 83 flat and the base 89 unfolded.

Figure 43:
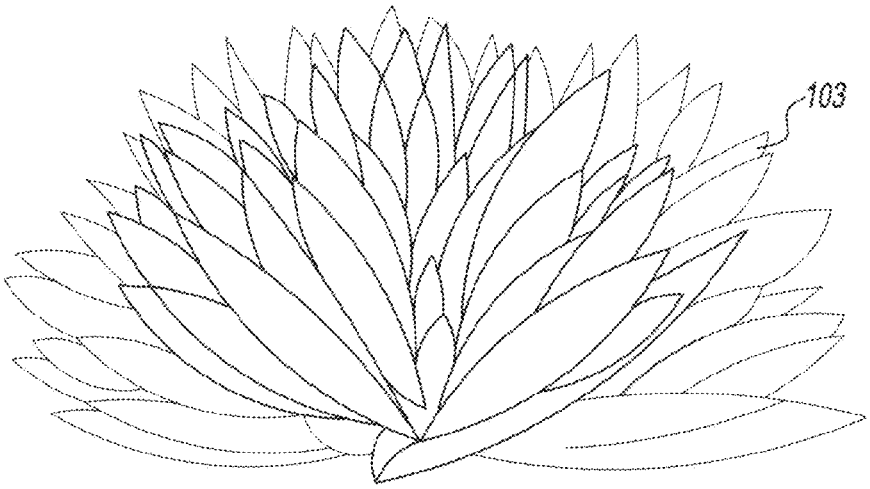
FIG. 43 shows an example of adhesive tape art.
Figure 44:
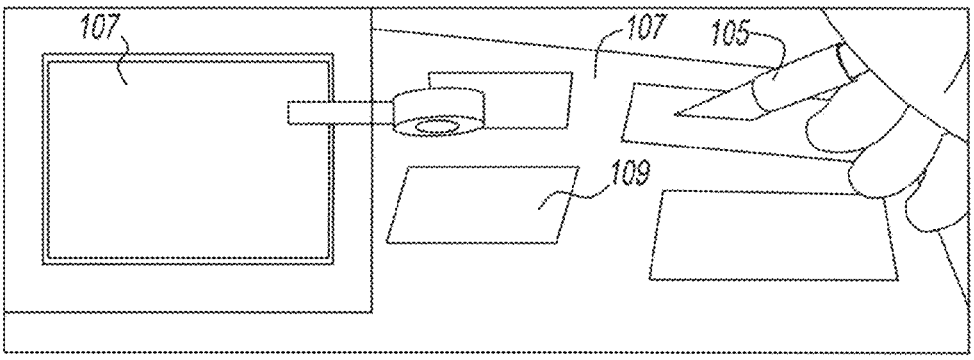
FIGS. 44-51 illustrate a method of producing adhesive tape art.
Figure 45:
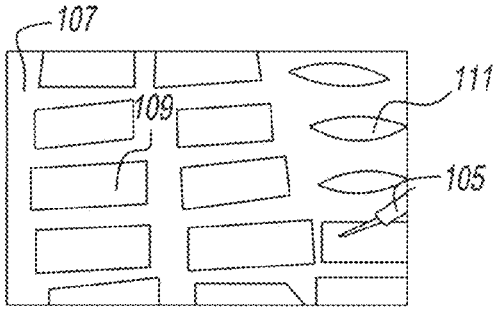
Figure 46:
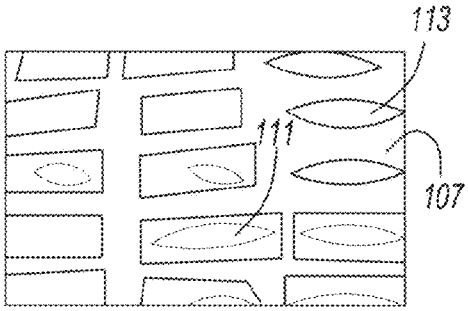
Figure 47:
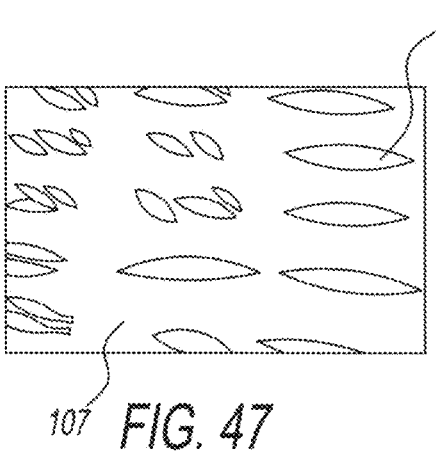
Figure 48:
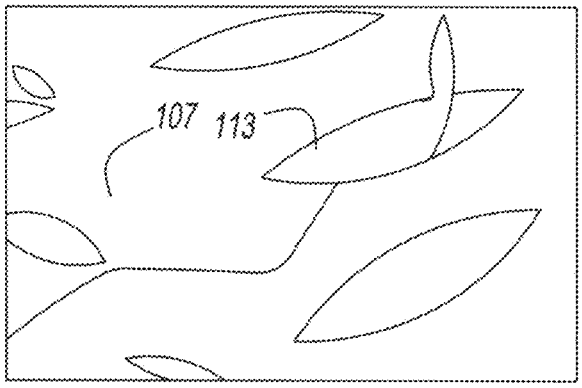

A user can explore many designs and optical effects using adhesive tape and origami cellophane. Overlapping pieces of adhesive tape create beautiful rainbow colors when viewed under polarized light, an example 103 of which is shown in FIG. 43. Users can create wonderful designs working with light and how light interacts with thin films such as adhesive tape and cellophane. One method for creating such designs requires a cutting tool such as a precision cutting blade 105 and a surface 107 on which to cut with the cutting tool as shown in FIG. 44. Any number of pieces of tape 109 of any length are placed on the cutting surface 107. With a sharp blade 105, desired shapes 111 are carved out within the tape pieces 109 and the unwanted tape is peeled off leaving the desired shapes 111 stuck on the cutting surface 107 as shown in FIGS. 45 and 46. The remaining fashioned out shapes of tape 113 on the cutting surface 107 are now ready to be peeled off to create designs as shown in FIG. 48. Flower petal-like shapes 113 have been sliced out in various sizes within the tape for this exercise for illustration purposes. Any kind of design or shape desired by a user can be made.

Figure 49:
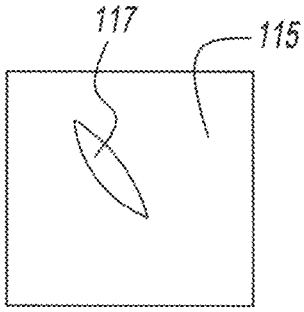
Figure 50:
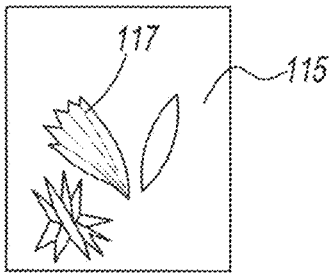
Figure 51:
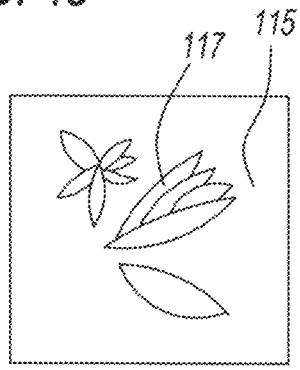

One sheet of origami cellophane 115 is taken and tape designs 117 are pasted on it as shown in FIGS. 49-51. The tape 117 is overlapped strategically in order to create a colorful effect as shown in FIGS. 50-51. The creations can then be viewed in polarized light using a polariscope, for example holding the creation in front of a portal holding a polarizing lens while wearing glasses containing polarizing lenses. Rotating the ring of the portal while holding the tape design on the cellophane sheet or rotating the cellophane sheet in front of the portal ring and wearing the glasses creates a kaleidoscope effect. This result is also achieved with the glasses and the cellophane held in front of the blue sky, a water surface, nonmetallic reflective surface or mirrored surface. This can also be achieved using two portal rings with the tape art on the cellophane sheet in between.

While wearing glasses with polarizing lenses, a photoelastic plastic model may be held up to the blue sky ninety degrees away from the sun and bent and/or squeezed to produce a display of rainbow colors. The blue sky polarizes the light in the same way as a portal or other polarizing film. Sticky photoelastic models can be stuck on windows and mirrors for viewing.

In a photoelastic entertainment method, the ring of a portal is held up to the sky ninety degrees away from the sun and rotated and the light coming through the portal changes. A sticky photoelastic plastic model is pressed gently onto the back surface of the ring of the portal in a slightly bent position and sticks to the surface. The ring is held up to the blue sky ninety degrees away from the sun with the front facing the user and rotated. Not only does the light coming through the portal ring change, but the rainbow colors show more as the light coming through the portal ring darkens.

In another embodiment, a photoelastic plastic model is gently pressed in a slightly bent position onto the front surface of the ring of a portal that is constructed in a horizontal position. A light is turned on and the ring with the plastic model stuck on its surface is placed over the light enclosed by the base of the portal. A user puts on the glasses and rainbow colors appear. The ring is picked up and rotated over the light while the user wears the glasses to change the colors like a kaleidoscope.

Figure 52:
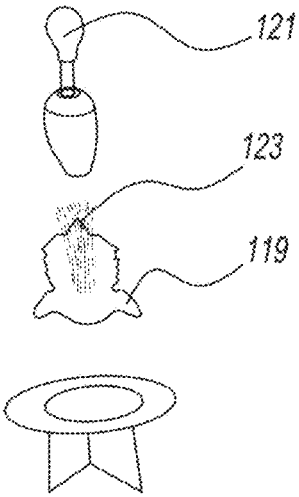
FIGS. 52-55 illustrate the use of glossy black cardboard to provide a polarized light source.

As shown in FIG. 52, a glossy black surface such as a glossy black piece of cardboard 119 is placed in front of bright light, for example from a window or from a lamp 121. Light is reflected off the surface of the black cardboard 119 and a strong reflection 123 is visible at a certain angle.

Figure 53:
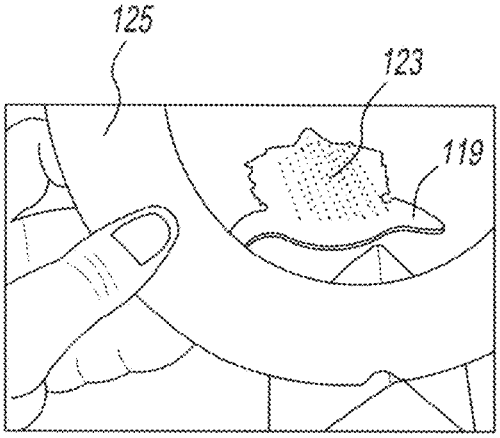
Figure 54:
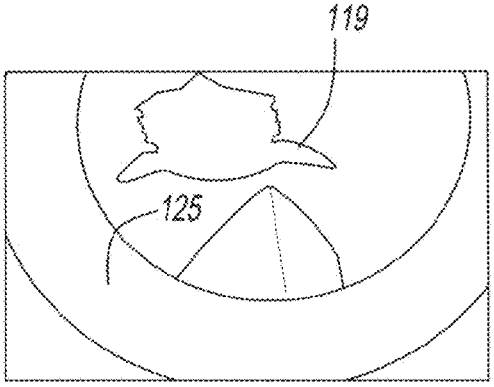

While watching the reflection at that angle, take the ring of the portal 125 and rotate it in front of that reflection. The reflection will appear to go away as shown in FIGS. 53 and 54.

Figure 55:
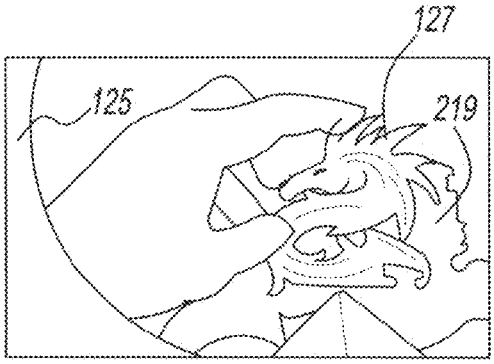

The ring can be positioned at that angle using the base of the portal in the vertical position. Now one of the plastic models 127 can be bent between the ring of the positioned portal 125 and the glossy black cardboard surface 119 and rainbows will appear as shown in FIG. 55. The glossy black cardboard acts like the blue sky, polarizing the light.

Figure 56:
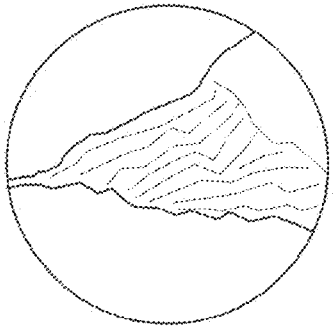
FIG. 56 illustrates the photoelastic properties of stretched plastic film.

Rainbows will similarly appear in some other plastics. Colors may be seen in thin plastic wrapping material when stretched, as well as in transparent adhesive tape. Thin cling-type plastic wrap as shown in FIG. 56 produces vibrant colors when stretched and viewed under polarizing light.

Many different designs and effects can be created and viewed by experimenting with cellophane, for example by looking at it with glasses and a portal, folding it, making origami patterns from it and viewing rainbows that appear in different patterns of folded cellophane when viewed in polarized light. Rotating the portal creates a kaleidoscope effect and different positions of the portal ring will show the best colors in the cellophane models. Overlapping adhesive tape can be applied on a cellophane sheet and the cellophane with overlapping tape can be rotated for a kaleidoscope effect. The tape can be cut into shapes to make a variety of images.

Figure 57:
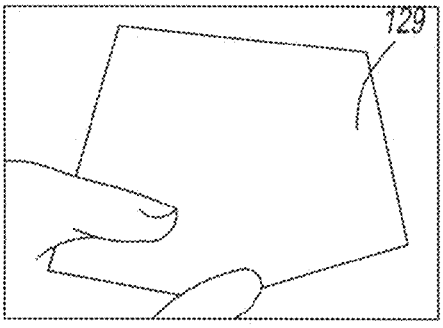
FIGS. 57-70 illustrate a method of creating and viewing cellophane origami models.
Figure 58:
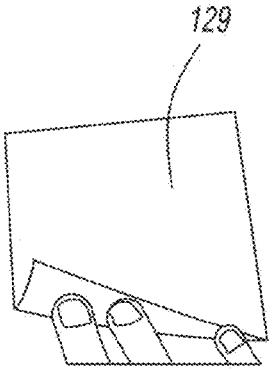
Figure 59:
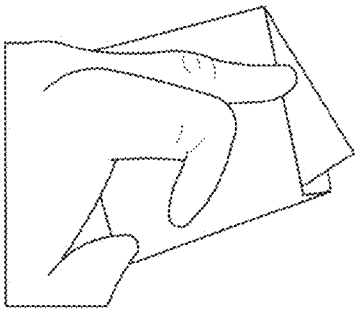
Figure 60:
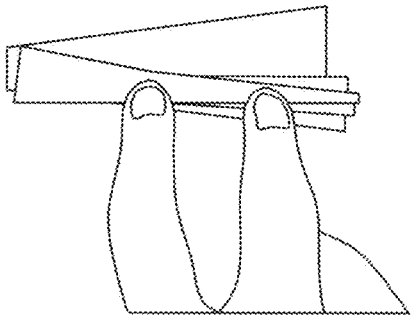

A sheet of cellophane, in this embodiment a 2.5 or 4 inch square, is used to create different shapes. In the figures, a larger plain white paper is used throughout to represent the cellophane, to make it easier to see the steps and folds. One edge of the square 129 is folded as shown in FIGS. 57 and 58, starting at one side of the square (FIG. 58) or at one point of the square (FIG. 57). The user can experiment with different angles and proportions of the fold and see the results on the end design. Starting at one point of the squarer works well for creating birds in flight, butterflies, moths, and dragon flies. The cellophane sheet is turned over and the fold repeated on the other side as shown in FIG. 59. The folds are continued as though making an accordion. The angle and proportion of the fold are varied so that segments of the accordion do not overlap perfectly as shown in FIG. 60.

Figure 61:
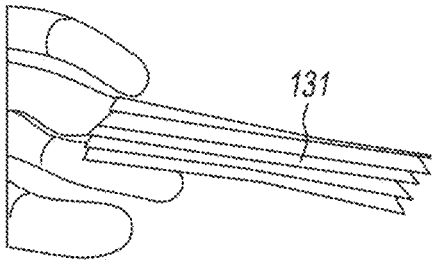
Figure 62:
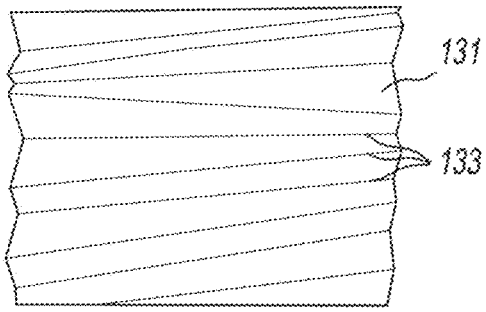
Figure 63:
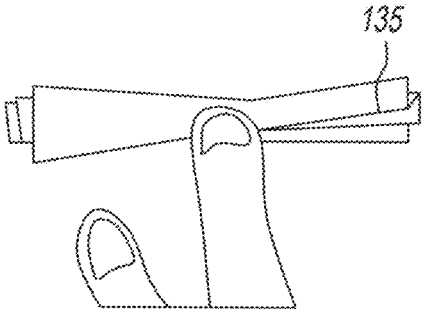
Figure 64:
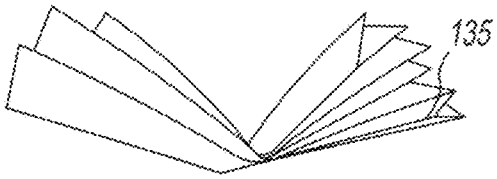
Figure 65:
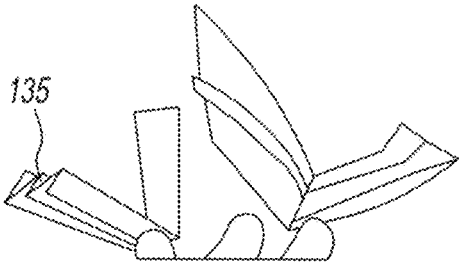
Figure 66:
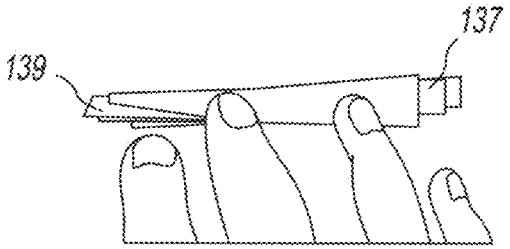
Figure 67:
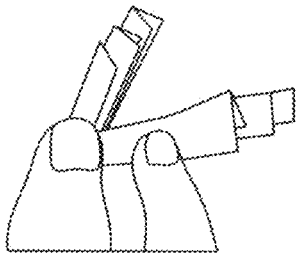
Figure 68:
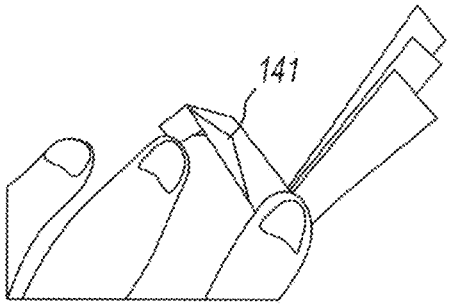
Figure 69:
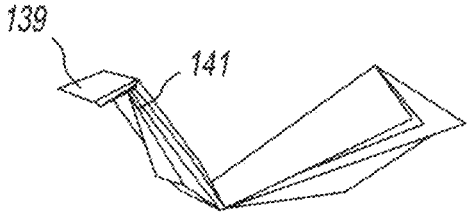

These folds are continued, turning the sheet over repetitively and alternating from the back to the front of the paper until the entire square makes a folded accordion 131 as shown in FIG. 61. The accordion piece 131 is shown unfolded in FIG. 62 to make the folds 133 more apparent. If folds are continued so that the edge of the fold rises to the same corner of the end of the sheet rather than folding from the back or front of the sheet, two ends that fan out like a bow tie will result as shown in FIG. 63. The bow tie 135 works well for designs of butterflies, dragon flies, moths and flying birds. The middle of the accordion-like piece that was created is taken and one side is folded up over the other at any desired angle as shown in FIGS. 64 and 65.

Figure 70:
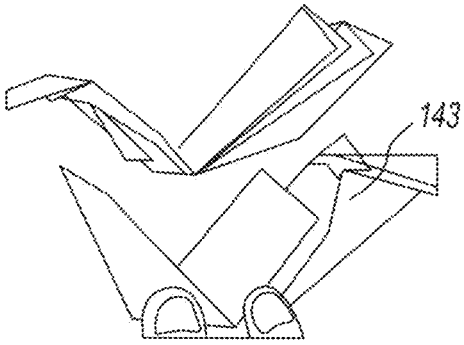

Another technique results in an accordion fold where one end is narrower than the other as shown in FIGS. 66-70. This can be accomplished by folding the front of the sheet so that the edge of the fold rises up to the end of the sheet on one side (ie the right side) and to the opposite side when folded from the back side (ie the left side). Folding in this manner makes an accordion-like piece 137 that is wide on one end and narrow on the other. This narrow end 139 makes the neck of a swan or a peacock. Another fold 141 near the narrow end separates out the head from the neck. FIG. 70 shows a resulting model in cellophane 143 as well as in paper.

Figure 136:
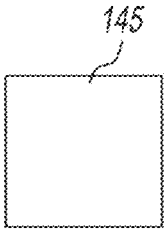
FIGS. 136-150 illustrate a method of creating origami cellophane birds and snowflakes.
Figure 137:
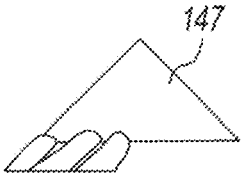
Figure 138:
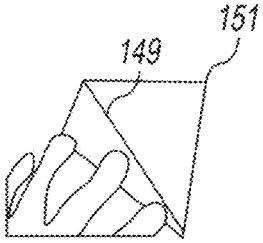
Figure 139:
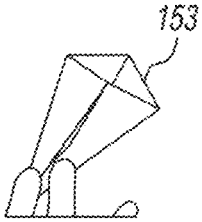
Figure 140:
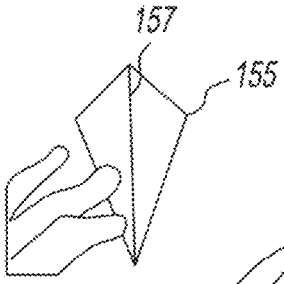
Figure 141:
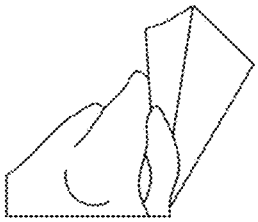
Figure 142:
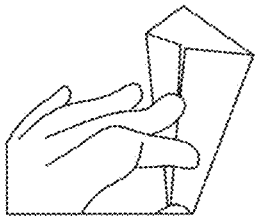

Another simple model for a peacock starts with an origami kite base. The method for making this model is illustrated in FIGS. 136-149. The 4 or 2.5 inch square cellophane kite base sheet 145 (FIG. 136) is folded into a triangle 147 (FIG. 137) and then unfolded (FIG. 138). As FIGS. 138 and 139 show, one side 151 is folded such that it lines up with the diagonal crease 149 made with the first fold. The same is done on the other side, resulting in the "kite" design 153 shown in FIG. 139, which is turned over and the new edge 155 is folded to the diagonal crease 157 as shown in FIGS. 140 to 142. The same is then done on the opposite side, resulting in the design shown in FIG. 143.

Figure 143:
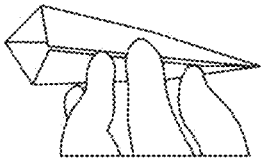
Figure 144:
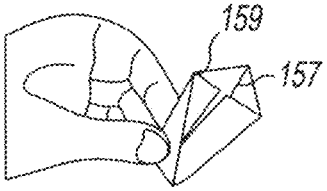
Figure 150:
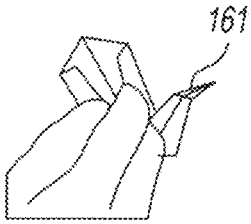

The point 159 of the resulting model is folded up along the middle crease 157 as shown in FIGS. 143 and 144. The point 159 of the crease is taken and folded over at an angle to make the head 161 shown in FIGS. 148-150. Variations can be produced by experimenting with different angles in folding the neck, head, or adding more folds in the tail part. Origami techniques can be applied, creating stars, snowflakes, animals, etc. Cellophane with polarized light invites a new way of experimenting with origami. The objective is not just to make a shape but also to make overlapping layers of cellophane so that rainbow colors appear.

The effect of overlapping cellophane and adhesive tape produces the colors not by photoelasticity, but by a process called reflection and interference, the same way rainbows in the sky, soap bubbles, and in oils slicks are formed.

Figure 145:
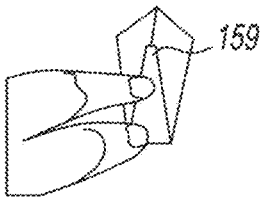
Figure 146:
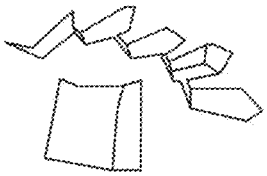
Figure 147:
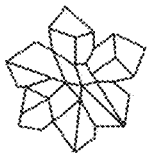
Figure 148:
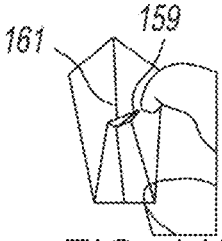
Figure 149:
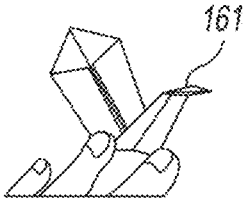

Origami models can be combined to make new ones, for example, a star. Starting with 2.5 inch square origami sheets, stars are made by starting with the piece made for the peacock, the result of which is shown in FIG. 145, and repeating five more times as shown in FIG. 146 for a six pointed star. The pieces are arranged in a circle with the flat ends overlapping at the center and the points extending outward as shown in FIG. 147.

A plastic plate or other plastic objects can be placed over it to enhance the effects of or to hold in place this and other cellophane origami models.

Figure 90:
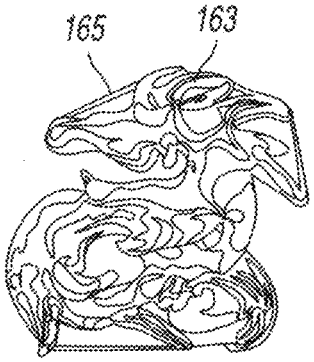

In some embodiments, flexible photoelastic toy models are suspended from cellophane (which can even be folded cellophane or tape art on cellophane) that is in strips or other configurations, allowing the toy to be stretched, twisted, or otherwise manipulated as a puppet. The cellophane and/or tape art serving as puppet strings make a complete display together. In some embodiments this comes as a kit with supplies and directions to create the cellophane and/or tape supports for the photoelastic puppet. In some embodiments, strings or attachments are made of photoelastic material for similar effects and colorful displays when used to manipulate an object under polarized light. FIG. 90 shows a flexible photoelastic toy model 163 manipulated with a cellophane strip and adhesive tape 165, where the adhesive tape holds together the model and cellophane strip. The cellophane strip 165 maintains the model 163 in a bent position, causing stresses within the model that give rise to rainbow colors when the model is viewed under polarized light.

Figure 88:
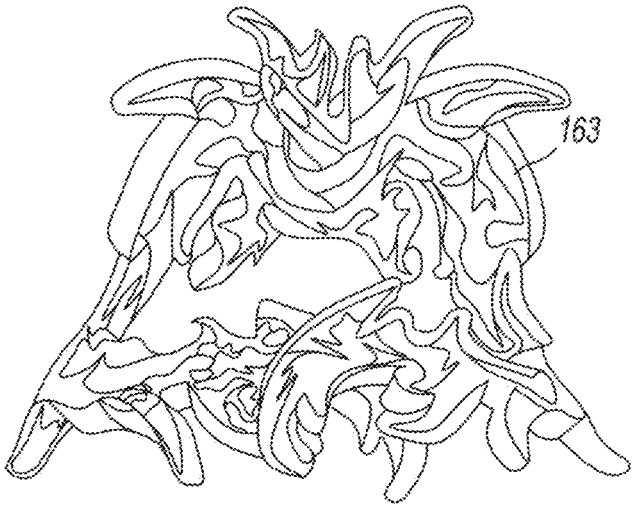
FIGS. 88-90 illustrate photoelastic models stuck to various objects to achieve stressed positions that result in colorful displays under polarized light.
Figure 89:
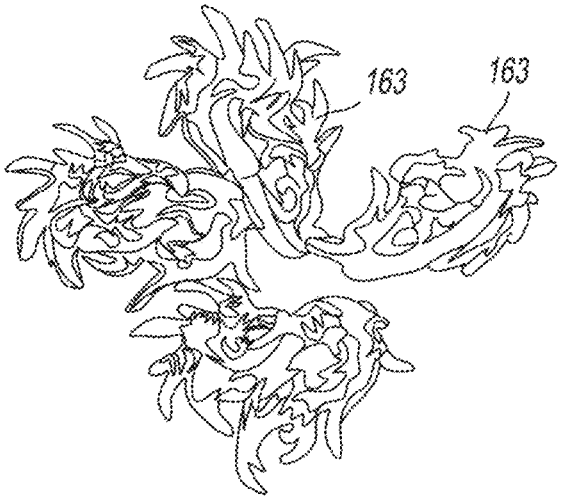
Figure 162:
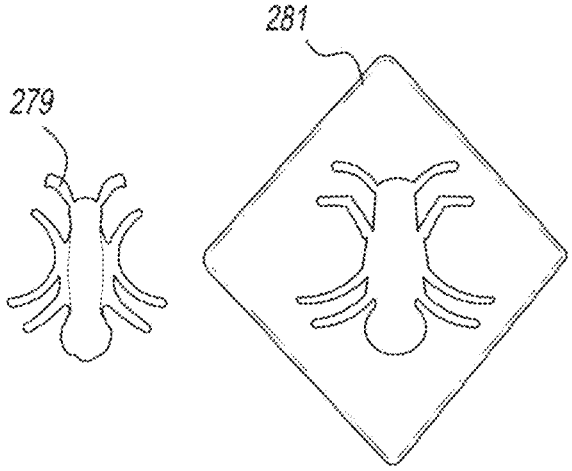
FIG. 162 illustrates photoelastic puzzle pieces.
Figure 163:
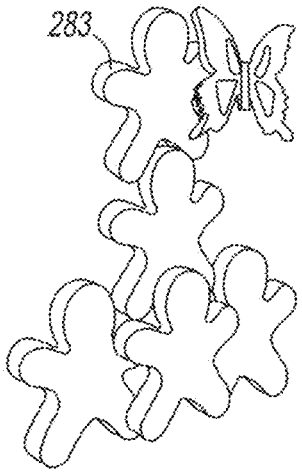
FIG. 163 illustrates photoelastic building blocks.

In some embodiments puppets, photoelastic or cellophane building blocks, puzzles or other objects stick to or attach to each other, allowing them to be manipulated together under polarized light, creating new designs, and/or stressing the objects to create certain colorful displays under the polarized light. FIG. 162 shows photoelastic models that are simple puzzles, wherein one piece, in this case an ant model 279, mates with and sticks to another model 281. FIG. 163 shows photoelastic models 283 that can also be used as building blocks, sticking to one another to form structures. FIGS. 88 and 89 show photoelastic models 163 stuck to other models and/or one part of a model stuck to a different part of the same model, fixing the models in positions different from their relaxed positions. In some embodiments, photoelastic toys or polariscopes/polarizing glasses used to view them glow in the dark to add to the display.

Figure 91:
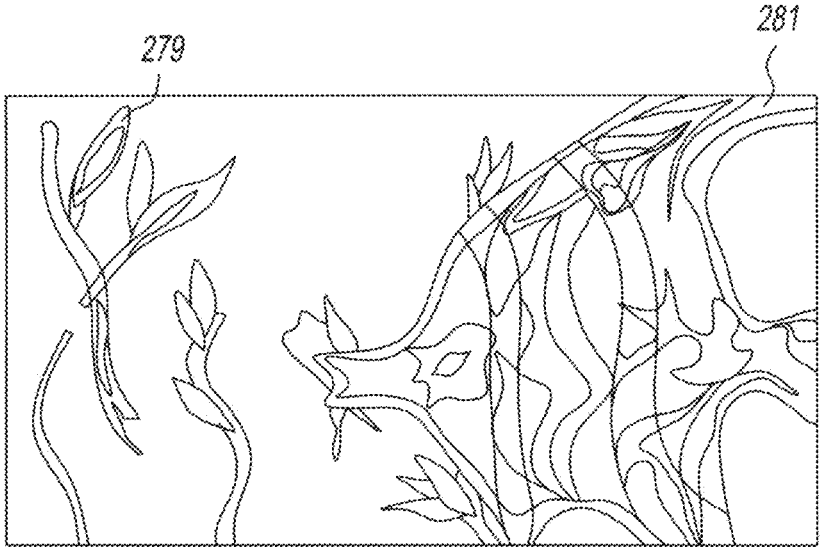
FIGS. 91 and 92 show the use of cellophane and adhesive tape background scenes for photoelastic objects.
Figure 92:
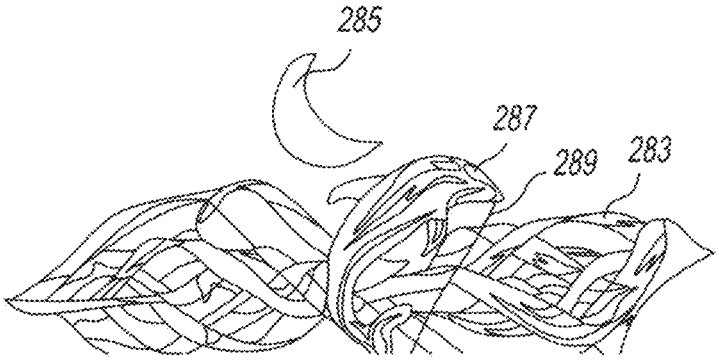

FIGS. 91 and 92 show the use of cellophane and adhesive tape background scenes for photoelastic objects. In FIG. 91, adhesive tape is shaped into various sea plant designs 279 to create a colorful ocean background for the photoelastic fish model 281. In FIG. 92, a three dimensional cellophane ocean model 283 and cut out cellophane cut into a moon design 285 form a colorful background for photoelastic dolphin model 287. The dolphin model 287 is stressed by the application of adhesive tape with a stripe of cellophane 289 which forces the model into a stretched position. By manipulating the cellophane background 283 and/or the polarized light, the cellophane ocean model 283 can be made to change color and shimmer, creating the appearance of a rising and falling moonlit ocean. Similarly, the dolphin model 287 can be manipulated by hand or with the attached adhesive tape 289 to appear to be moving through the ocean. Similar effects can be achieved, for example, with a background in the shape of flames and a photoelastic dragon model.

Figure 93:
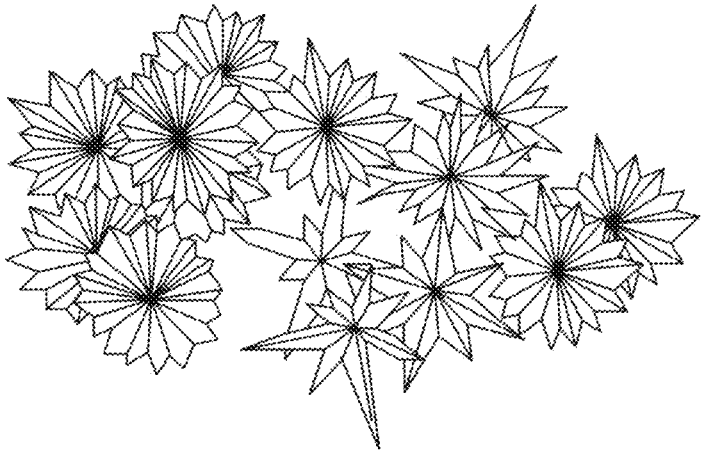
FIG. 93 shows various cellophane designs.

FIG. 93 shows various cellophane designs 291 created by folding and cutting of cellophane sheets and viewed under polarized light.

In some embodiments, soft flexible prism toys can be used as personal ornaments like bracelets, necklaces, rings, etc. These need not show rainbow colors while they are being worn, but can be removed to see rainbow colors with the necessary polarizing options/supplies, such as polarizing glasses used with the sky, a computer screen, or a nonmetalic surface (such as water or black glossy cardboard/plastic) or mirrored surface of any kind, and/or additional films or with a toy polariscope. In some embodiments, polarizing or other films can also be used as personal ornaments and hung from or shaped into a necklace, bracelet, etc., or worked into a dress or other article of clothing. The polarizing film can then be used for play, for example with the blue sky or a computer or television screen and a photoelastic model or cellophane, tape, etc., with the user able to bend or fold the film to control the orientation of polarized light.

Photoelastic plastic toys in some embodiments represent characters and can be collectable action figures or items that can be worn, which represent qualities that the individual who possesses it wants to assume or be identified with. These toys, unlike other plastic toys that might be worn, have the special quality of being photoelastic and of presenting brilliant displays of color when viewed under polarized light.

A foldable polariscope can be made of cardboard or another suitable material. New foldable toy polariscopes are versatile, lightweight, and allow multiple ways to work with various displays, including window displays. Photoelastic toys such as building blocks/puzzles can be configured into different shapes and positions and even cellophane sculptures/building blocks can be displayed using this polariscope.

Figure 94:
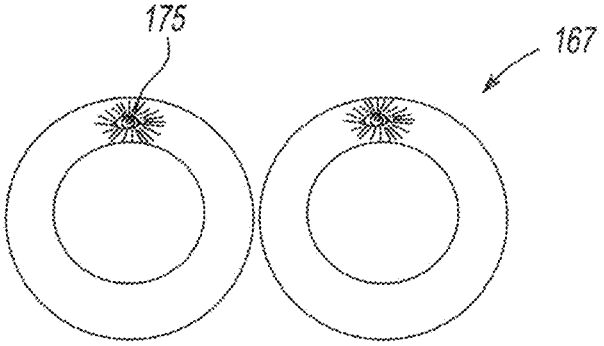
FIG. 94-98 illustrate the securing of optical art between portals using clips.
Figure 95:
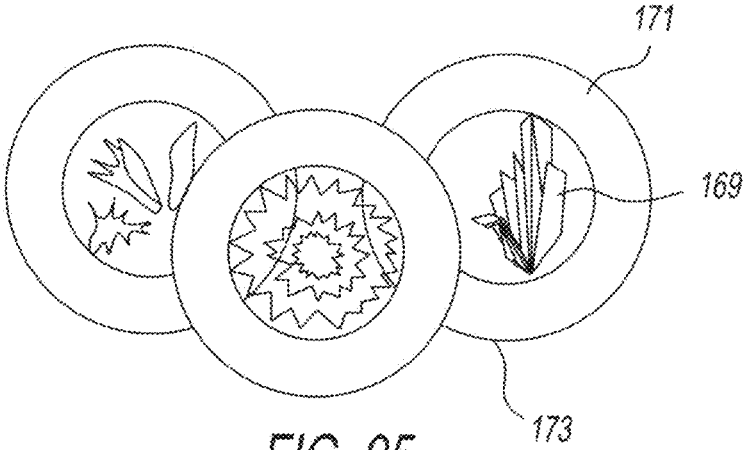

Users can create their own original art with origami cellophane, cut outs, adhesive tape, and/or design adhesive tape and explore them in conjunction with a set of portals 167 as shown in FIG. 94. In one embodiment, art work 169 is laid on the back of one of the portals 171, with a notch 173 in the portal at the bottom and an eye graphic 175 at the top of the portal on the other side (the notch and eye are aids for setting the portal in a certain rotational position) as shown in FIG. 95.

Figure 96:
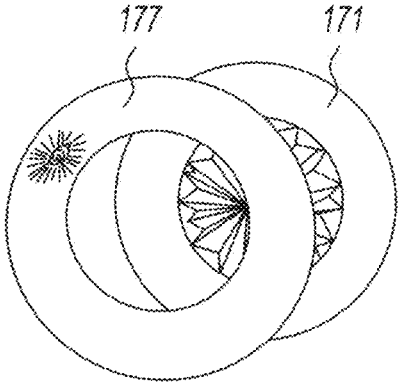
Figure 97:
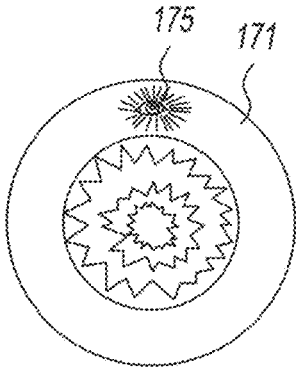
Figure 98:
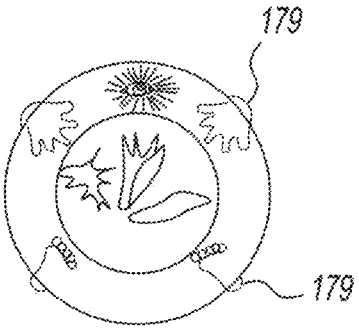

A second portal ring 177 is placed with the front facing upward on top of the first ring 171 that has its front facing down as shown in FIG. 96. The user rotates the second ring 177 until the user is happy with how the colors show. The sandwiched display is turned over until the first portal 171 is on top, at which point the eye 175 on the portal ring should be on top as shown in FIG. 97. The art can be secured between the two portal rings with paper clips 179 as shown in FIG. 98. Paper clips are not provided in all embodiments.

Figure 99:
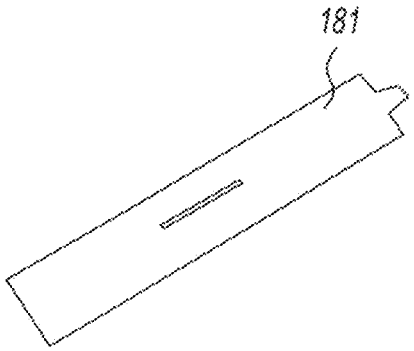
FIGS. 99-105 illustrate the folding of a base stand and the insertion of portals into a slit in the base stand.
Figure 100:
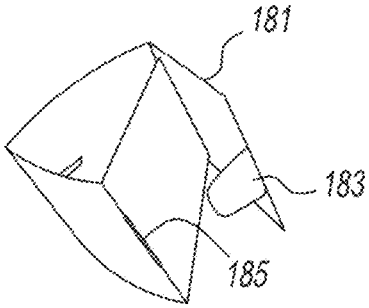
Figure 101:
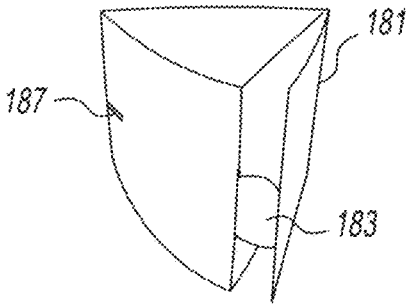
Figure 102:
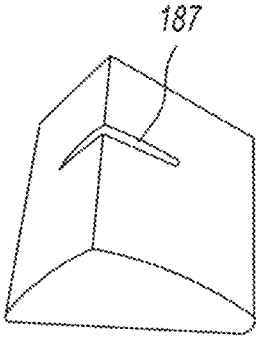
Figure 103:
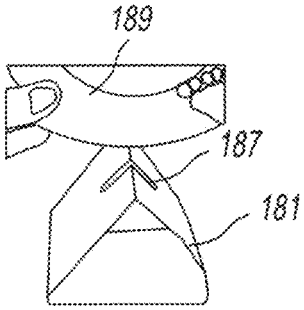
Figure 104:
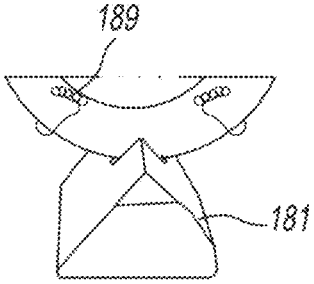
Figure 105:
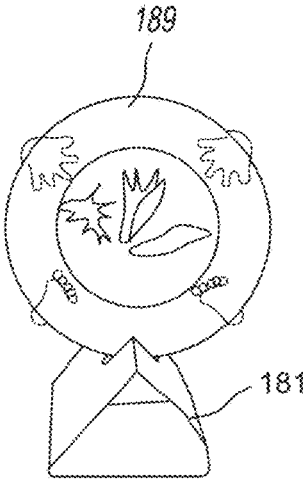
Figure 106:
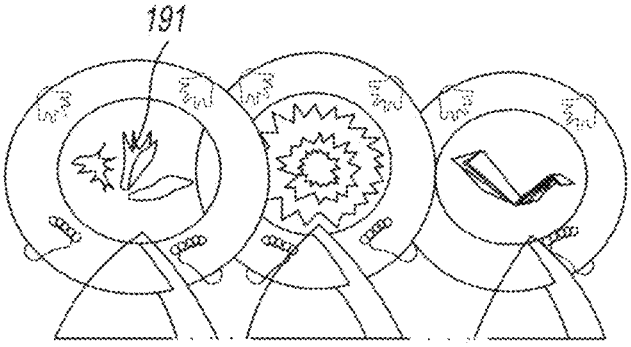
FIG. 106 shows optical art secured between polarizing portals, placed in a base stand and displayed in front of a window.

The art can be made to stand independently. The base 181 of a portal shown in FIG. 99 is folded into a triangular form with a tab 183 at the end exposed as shown in FIG. 100. The tab 183 is inserted into a slit 185 as shown and the base 181 is stood up so that a large slit 187 is on top as shown in FIGS. 102 and 103. An optical art display secured between the two portal rings 189 is inserted into the large slit 187 on top of the portal base 181 as shown in FIGS. 103-105. The result is a vertical display position for a portal, with the art between two portal rings. The art is then ready for display, for example in front of a light or window as shown in FIG. 106. The art can also be displayed in other ways, for example hung in front of a window using a clip and string.

Figure 107:
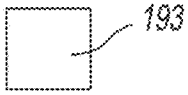
FIGS. 107-115 illustrate the construction of a cellophane design.
Figure 108:
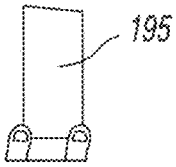
Figure 109:
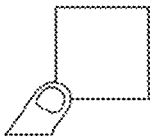
Figure 110:
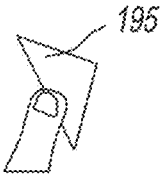
Figure 111:
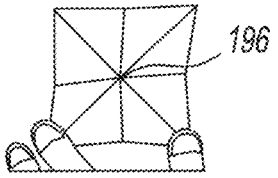
Figure 112:
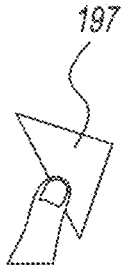
Figure 113:
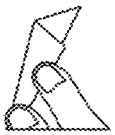
Figure 114:
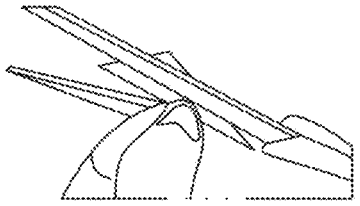
Figure 115:
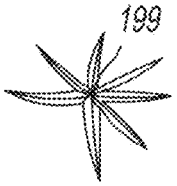

A variety of optical art 191 can be made with cut-out cellophane as illustrated in FIG. 106. In one embodiment, a square of optical art cut out cellophane 193 as shown in FIG. 107 is folded it in half as shown in FIG. 108, making a rectangle 195, folded in half again length wise as shown in FIG. 109, and folded in half diagonally as shown in FIG. 110. All fold lines converge in the center 196 of the square as shown in FIG. 111. The resulting triangle 197 in FIG. 112 is folded, joining the two longest sides as shown in FIG. 113. Again, all fold lines converge in the center of the square. The folded triangle is turned over and a cut is made as shown in FIG. 114 from the narrow pointed end of the triangle from the open side upward and toward the fold and the art is unfolded to produce a star-like design 199 as shown in FIG. 115.

Figure 116:
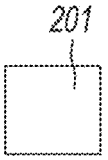
FIGS. 116-124 illustrate the construction of a cellophane design.
Figure 117:
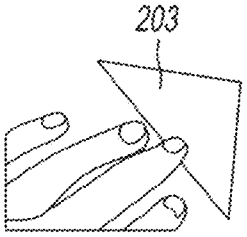
Figure 118:
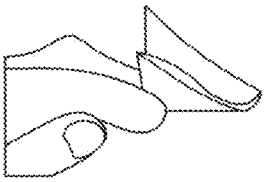
Figure 119:
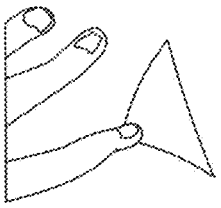
Figure 120:
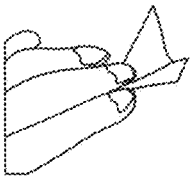
Figure 121:
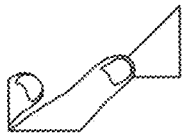
Figure 122:
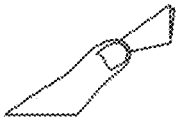
Figure 123:
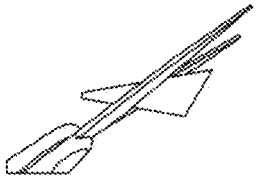
Figure 124:
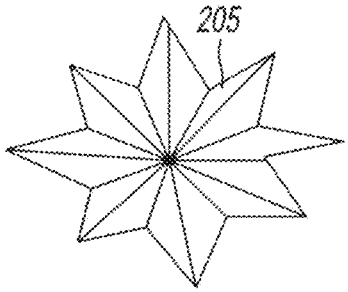
Figure 125:
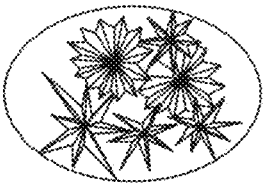
FIG. 125 shows various cellophane designs.

In another embodiment, a square of optical art cut out cellophane 201 as shown in FIG. 116 is folded in half diagonally as shown in FIG. 117. The resulting triangle 203 is folded in half again along its longest side as shown in FIG. 118 and this is repeated as shown in FIGS. 119-122 until the triangle is too small to fold any more. A cut is made above the point from the fold to the open side as shown in FIG. 123, aiming upward from the point of the triangle. The cellophane is then unfolded and the result 205 as shown in FIG. 124 can be seen under polarized light for example by placing it between portal rings and mounting on a portal base, and/or displaying it in a window. The resulting shape can be varied by varying the angle of the cut, with various results shown in FIG. 125.

Figure 126:
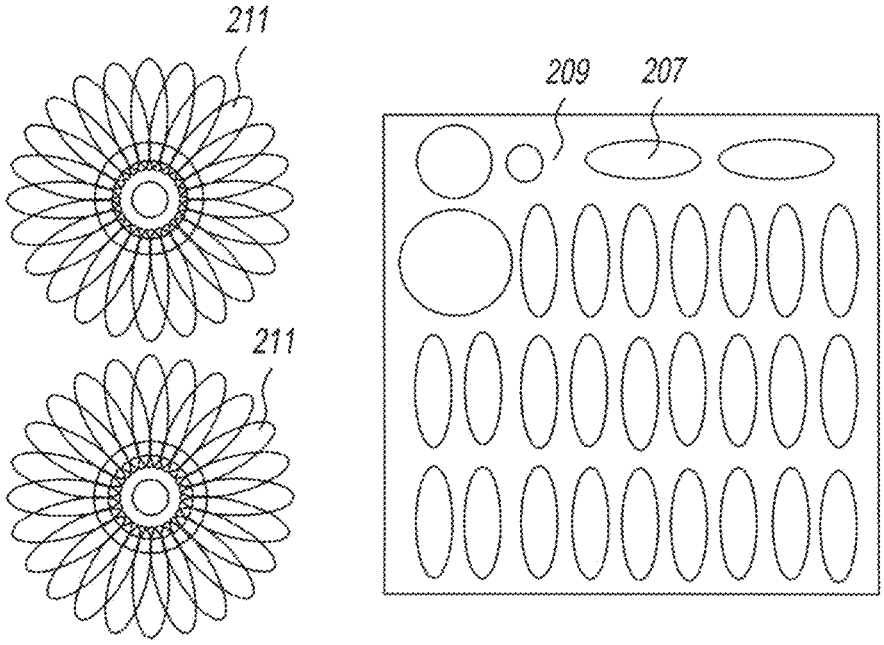
FIG. 126 shows a pre-cut adhesive tape set.

FIG. 126 shows a precut tape set for making optical art with adhesive tape. The set contains a number of precut pieces of tape 207 for use in constructing optical art 211 on a backing 209. The precut pieces of tape eliminate the need to use a blade to cut out tape pieces and may be customized to produce certain types of designs, such as flowers in the example shown in FIG. 126.

Figure 127:
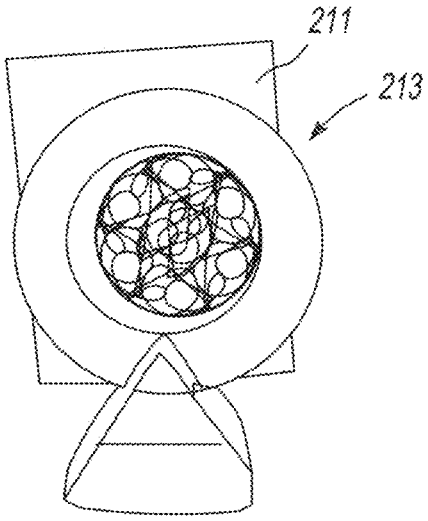
FIGS. 127-128 show an injection molded plastic insert secured between portals on a stand.
Figure 128:
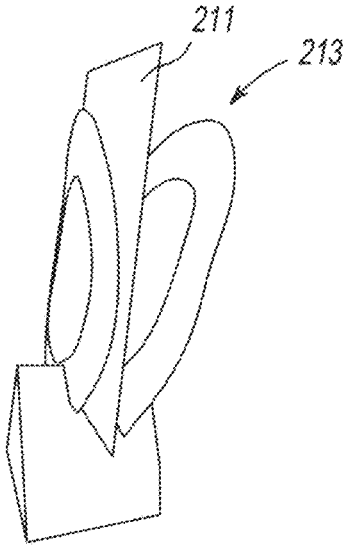

FIG. 127 is a front view of a photoelastic injection mold insert 211 displayed in a toy polariscope 213 making use of the portals and base as described above. FIG. 128 is a side view of the same display.

Figure 129:
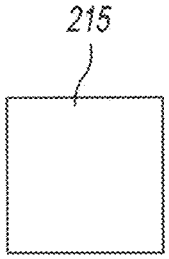
FIGS. 129-135 illustrate a method of creating a cellophane origami model.
Figure 130:
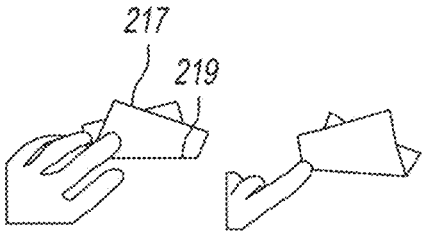
Figure 131:
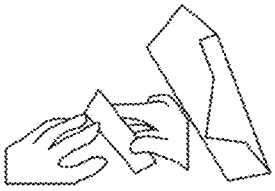
Figure 132:
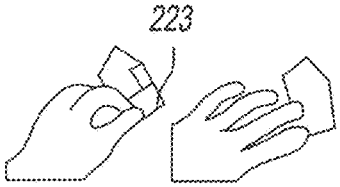
Figure 133:
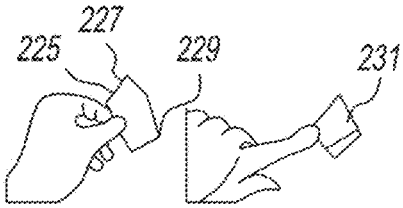
Figure 134:
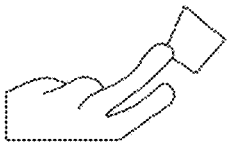
Figure 135:
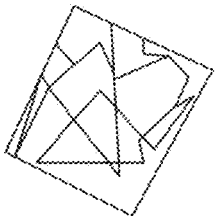

A variety of optical art can also be made with origami cellophane. In one embodiment, a square of 4-inch origami cellophane 215 as shown in FIG. 129 is taken and a fold is made in an oblique manner as shown in FIG. 130. The side with three of the corners of the square 217 is taken and folded length-wise toward the fold line 219 as shown in FIG. 131. One of the corners remains on top, resulting in a coffin-like appearance. The narrow end 221 is folded up toward the wider area at a fold line 223 that is about a third of the way along the length as shown in FIG. 132. The top of the coffin 225 that has the remaining corner of the original square 227 is folded toward the fold line 229 as shown in FIG. 133, creating an irregular diamond shape 231. The structure is turned over as shown in FIG. 134 and viewed under polarized light by, for example, placing between portal rings, mounting on a portal base, and/or displaying it in a window.

In some embodiments, small inserts 233 hold rings 235 in the slits 237 of a base 239 by providing increased thickness as shown in FIGS. 156-159. In some embodiments, these are foldable rectangles 2" by 3.75" and each insert folds in half to be about 1" by 3.75". The ring fits within the folded space of 1". Each two-ring set of portals may have 7-8 inserts each.

Figure 72:
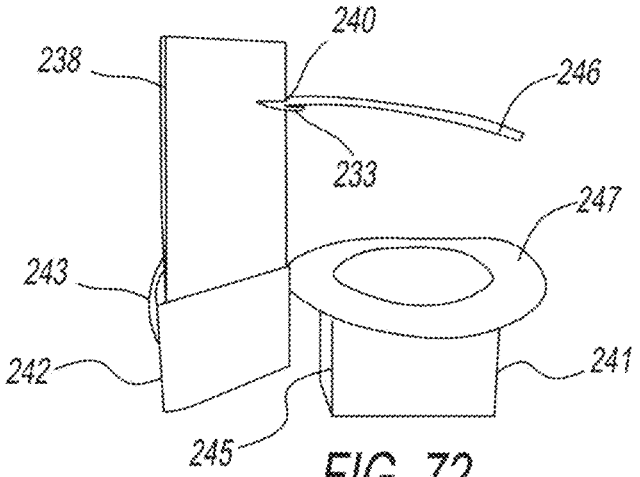
Figure 73:
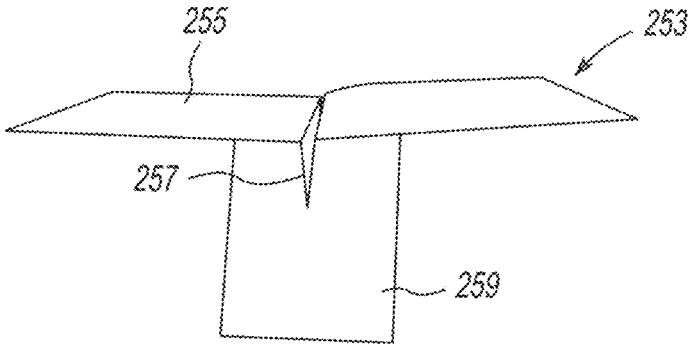
Figure 74:
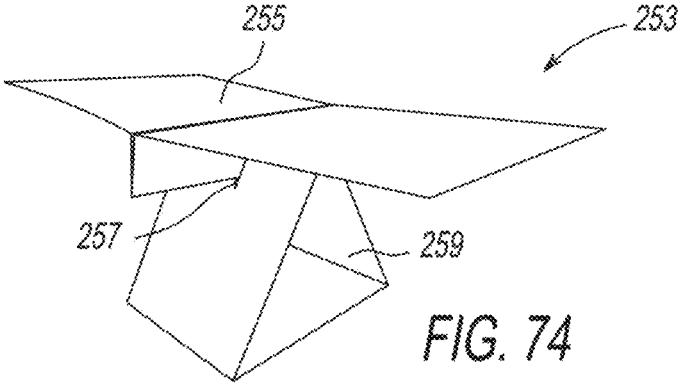
Figure 75:
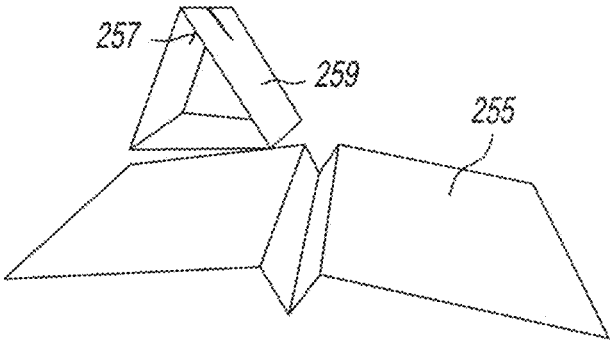

A stand 238 for a horizontal ring position (shown in FIG. 72) in one embodiment is about 9" tall with slit 240 placement at about 7.5" from the bottom. The slit size and configuration may be the same as that on top of the portal base 241 for vertical placement of a ring. Depending on the construction of the stand, the weight of the ring 246 when inserted in slit 240 can tend to topple the stand 238. In the illustrated embodiment, the stand 238 is a lightweight folded paper stand, and is thus supported by a portal base 242 surrounding the bottom of the stand to resist tipping.

Figure 160:
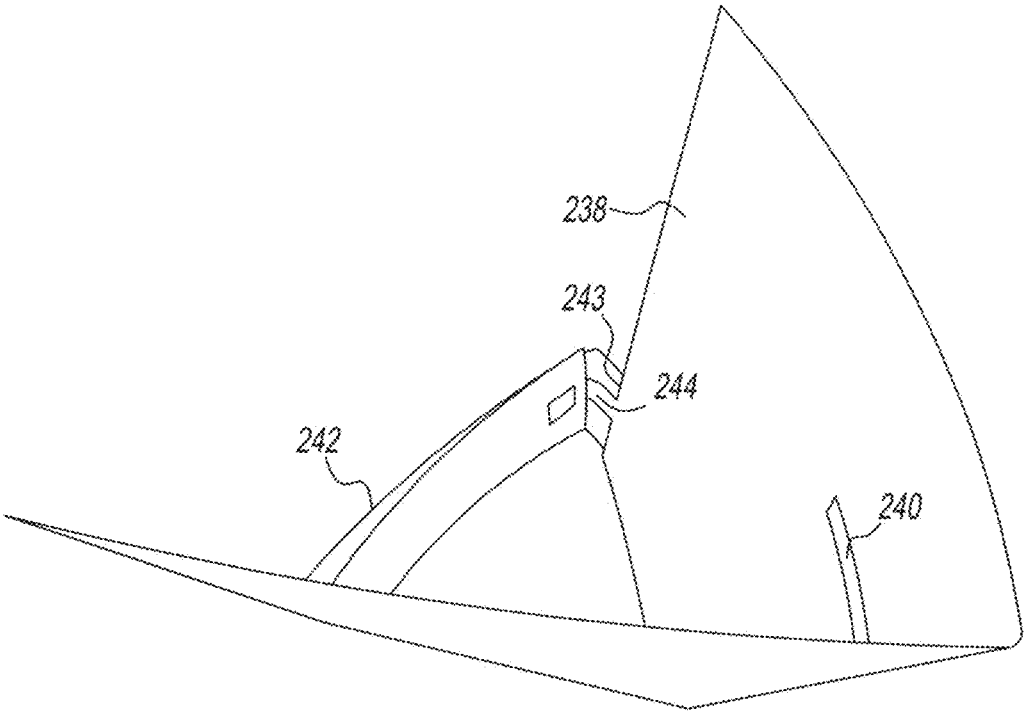
FIG. 160 illustrates a horizontal polariscope stand with a tab inserted in a portal base slit.
Figure 161:
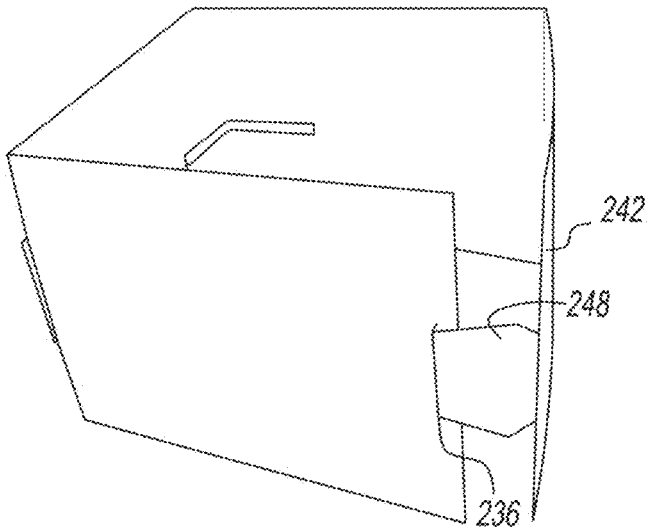
FIG. 161 illustrates the construction of a rectangular portal base.

In some embodiments, small tabs on the bottom sides 243 of the stand 238 can be inserted into small side slits in the portal base 242 to secure them together. In this way, the portal base 242 provides weight that can counterbalance the weight of the supported portal ring 246 plus the weight of the four small inserts 233 providing thickness to hold the ring 246 in place in the slit 240. In the illustrated embodiment, the portal base 242 has folds, tabs, and slits for creating a triangular or rectangular cross-section and for holding inserted objects, and the tabs on the stand 238 are designed to fit into one of the existing slits. In other embodiments, other stabilizers can be used in place of the portal base, however the portal base is convenient in that it can also be reused as a stand for a portal ring, etc. FIG. 160 shows a small tab 244 of the stand 238 inserted into a slit of portal base 242. FIG. 161 shows that this slit 236 can be used in conjunction with tab 248 of base 242 to form another, rectangular configuration for the base as shown for base 241 in FIG. 72.

Figure 71:
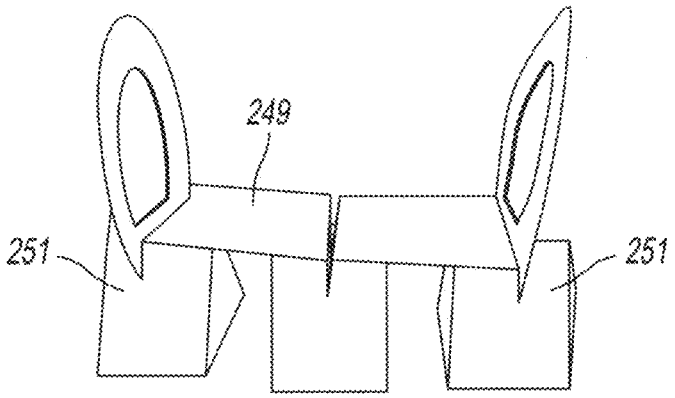
FIGS. 71-83 illustrate the use of vertical and horizontal polariscope stands.

A stand 249 for the vertical position (shown in FIG. 71) in one embodiment is a rectangle 11" long and 4.75" wide that folds into a rectangular area that is about 9" long and 4.75" wide. The height of the folded insert 251 of this stand is about 1". Another box-like object can be placed to add more height to the stand that is about 1" high.

A stand 253 for supporting art displays with cellophane and toy models uses a vertical position of a toy polariscope. A foldable rectangular piece of black glossy cardboard 255 is inserted into the slit 257 of the base 259 of the portal in the vertical position.

Figure 76:
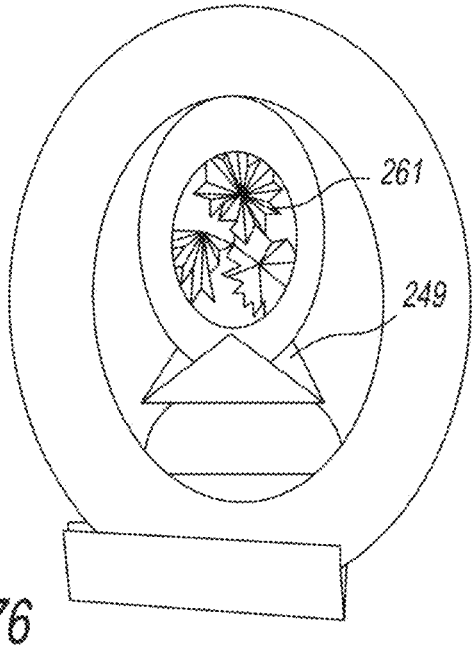
Figure 77:
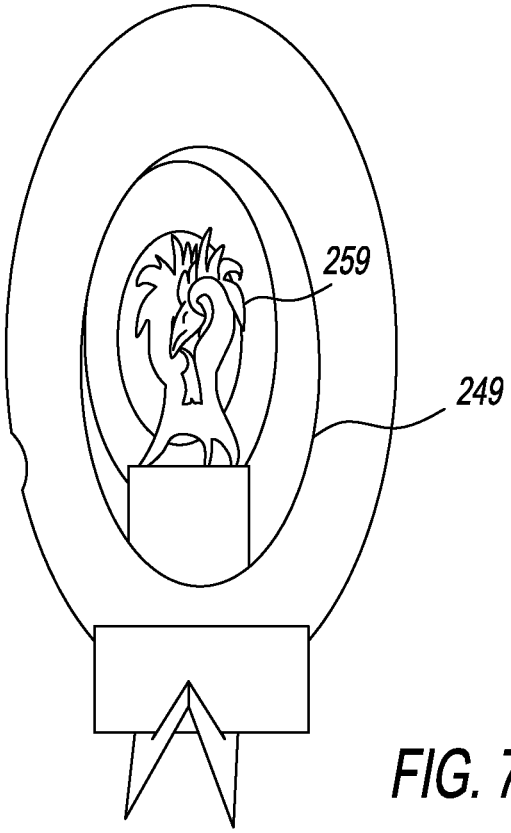

A new stand holds cellophane optical art sculptures and toy model building block and puzzle displays. FIG. 76 shows an optical art sculpture with cellophane 261 and FIG. 77 shows photoelastic dragon models 263 configured so that they stand up in a display. The dragon models can be created, for example, with injection molding. Use of black glossy cardboard 249 allows both the stand and the film to provide a source of polarized light and colors can also be seen in the reflected black glossy surface of the stand.

Figure 78:
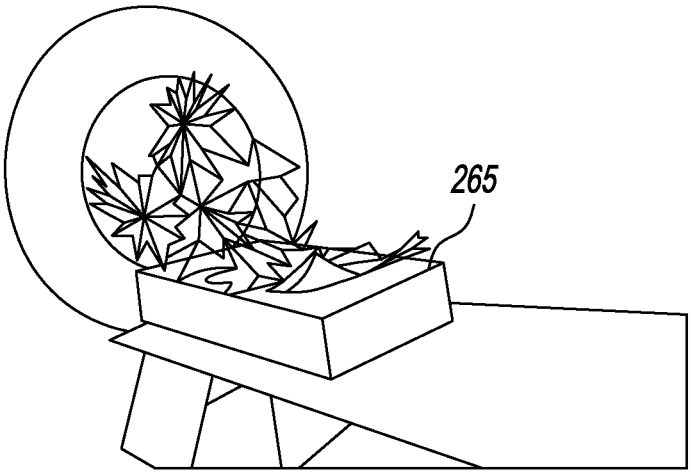
Figure 79:
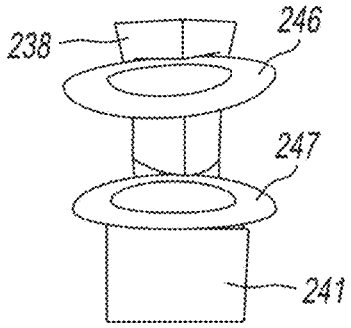
Figure 80:
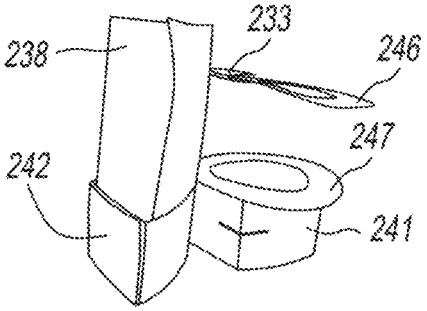
Figure 81:
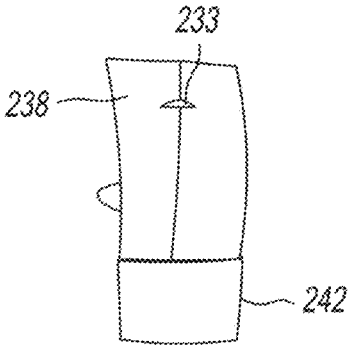
Figure 82:
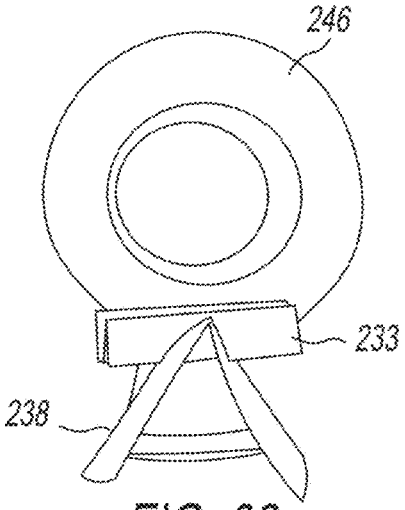

A small box or foldable piece 265 can add height to the stand as shown in FIG. 78 so that sculptures can be seen best through the space of the films of the rings. Another solution is use of the box of the toy itself in place of the stand pieces. A black glossy cardboard can be laid on top of the box or the box can itself have a black glossy surface.

Figure 83:
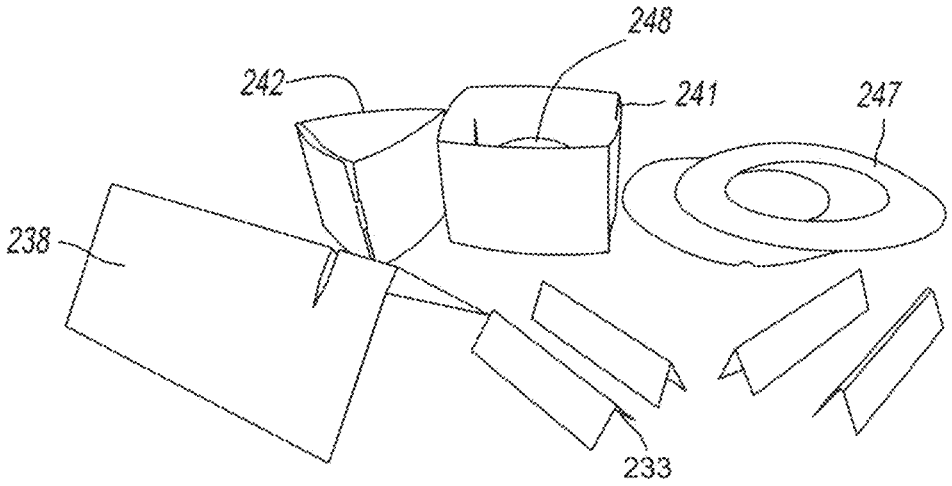
Figure 84:
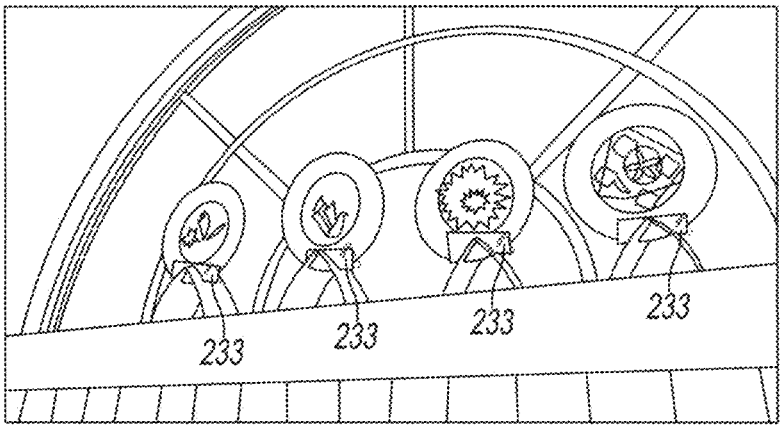
FIGS. 84-87 illustrate the use of inserts and clips to secure portals within stand slits.
Figure 85:
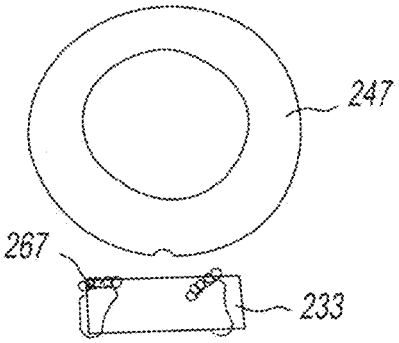
Figure 86:
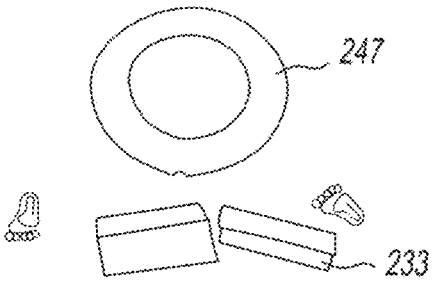
Figure 87:
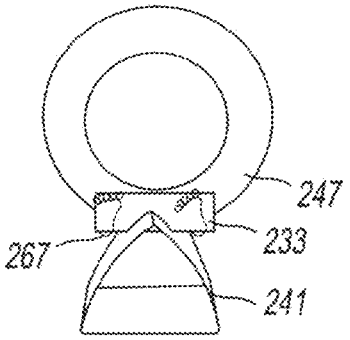

A foldable stand 238 for supporting a portal ring as shown in FIGS. 72 and 79-82 provides a simple solution for using a horizontal position with a light source without the need for glasses. FIG. 83 shows the stand and other parts of FIGS. 72 and 79-82 disassembled. The light source 248 within base 241 is visible in this figure. For the stand 238 to support the ring 246 in a horizontal position, small inserts 233 can provide thickness for a ring within the slit 240.

Small inserts can help stabilize rings in slits in a portal base 241 as well as in slits for stands 238 for the horizontal position. The inserts can be added together to vary the thickness needed for one or two rings together within a slit. FIGS. 84-87 show inserts being applied to portals 247 and secured with clips 267 and inserted into a slit in base 241. When two rings are put together for art displays sandwiched between the rings, only two inserts may be needed. When only one ring is in a slit, three inserts folded together may be needed. As many as four may be needed for the slit in the horizontal stand.

Figure 151:
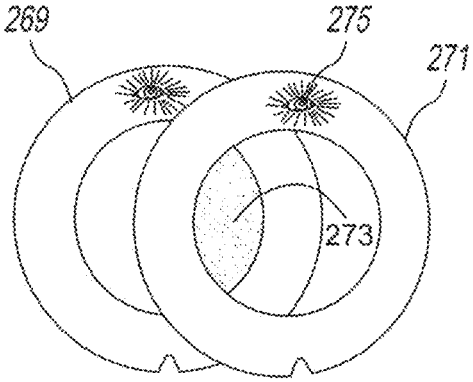
FIGS. 151-155 illustrate zero degree and ninety degree portals and their interaction with polarizing glasses.
Figure 152:
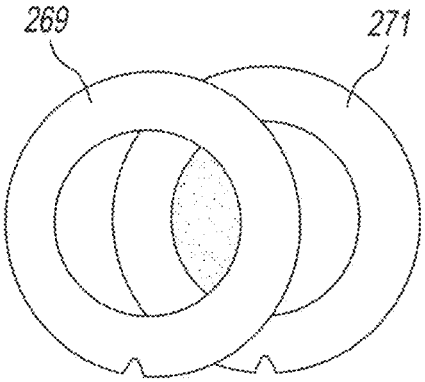
Figure 153:
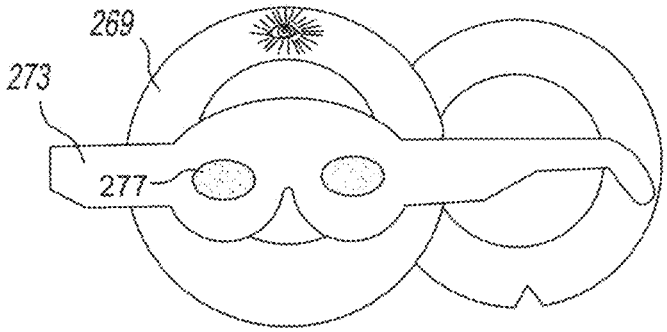

FIGS. 151 and 152 show the front and back displays, respectively, of a regular 90 degree portal ring 269 overlapping a zero degree portal ring 271. Note that the overlapping area 273 is dark with the eyes 275 of each ring oriented on top of each portal. This is because the film in the zero degree portal ring 271 is cross polarized with that in the 90 degree portal ring. The film in the glasses 273 is cross-polarized with regular 90 degree portal rings 269 when the portal ring is oriented such that the eye graphic 275 is on top. Note that the openings 277 for the eyes in the glasses are dark in FIG. 153.

Figure 154:
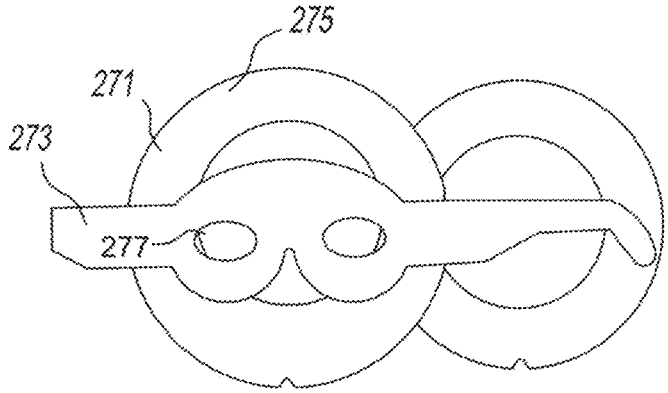
Figure 155:
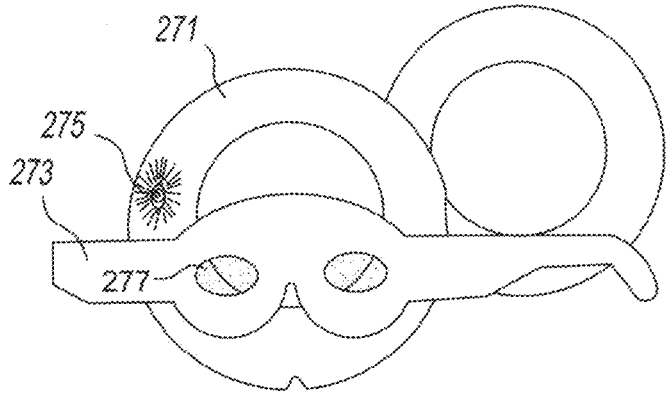
Figure 156:
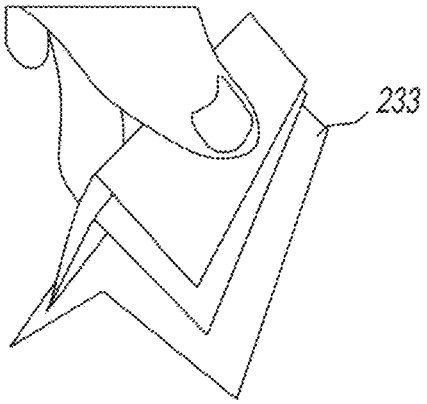
FIGS. 156-159 illustrate the use of inserts for securing portals within slits in stands.
Figure 157:
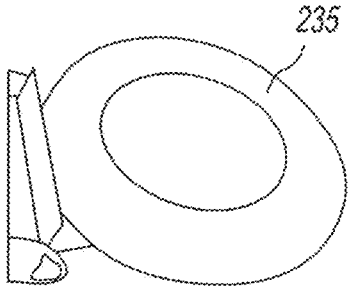
Figure 158:
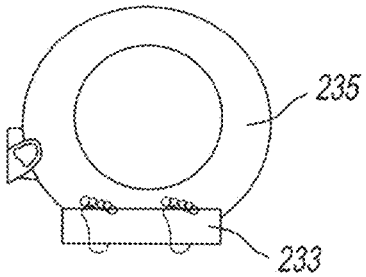
Figure 159:
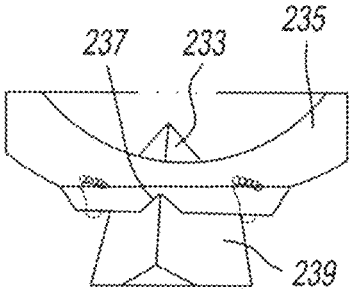

The film in the glasses are not cross polarized with that in the zero degree portal rings 271. That is why the area of the eye openings 277 in the glasses 273 in FIG. 154 do not appear dark over the zero degree portal rings 271 when the eye 275 on the ring is positioned on top. To achieve a cross-polarized position with the glasses using the zero degree portal rings, the zero degree portal ring is oriented so that the eye 275 is directly to the left or right side of the ring as shown in FIG. 155. The cross-polarized position is usually the best position for seeing the prismatic rainbow colors in the soft flexible prisms or other photoelastic objects. The area of the eye openings in the glasses is now dark as it is cross-polarized with the zero degree portal rings when the eye of the portal ring is oriented to the left or rights side instead of on the top as with regular 90 degree portals.

In some embodiments, polarizing glasses or other lenses are oriented at 135 degrees, in order to be cross-polarized with LCD screens in computers and TV's.

Figure 164:
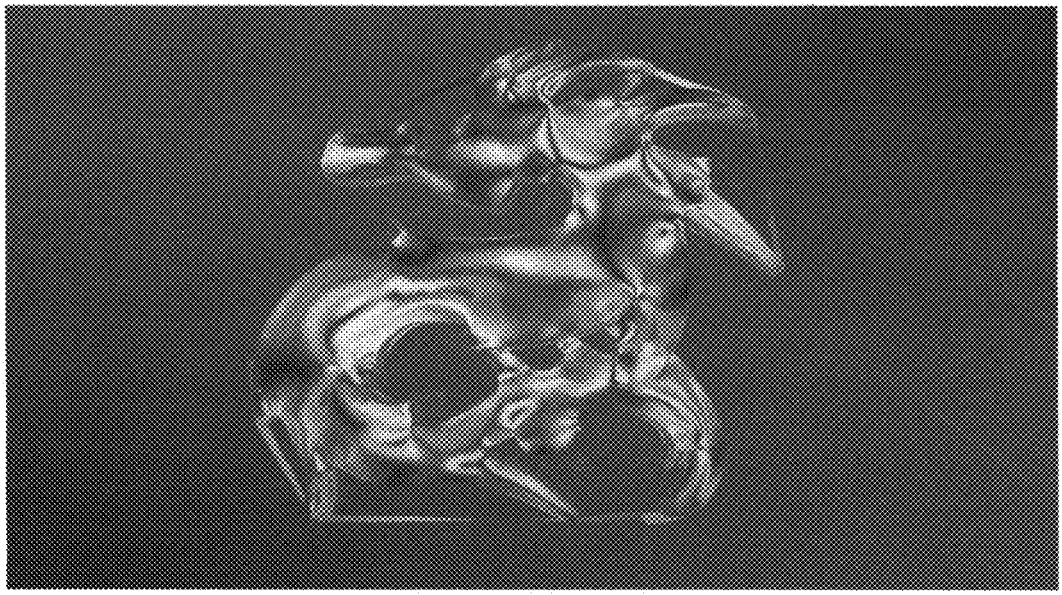
FIGS. 164-167 are color photographs of FIGS. 90, 92, 14, and 31, respectively.
Figure 165:
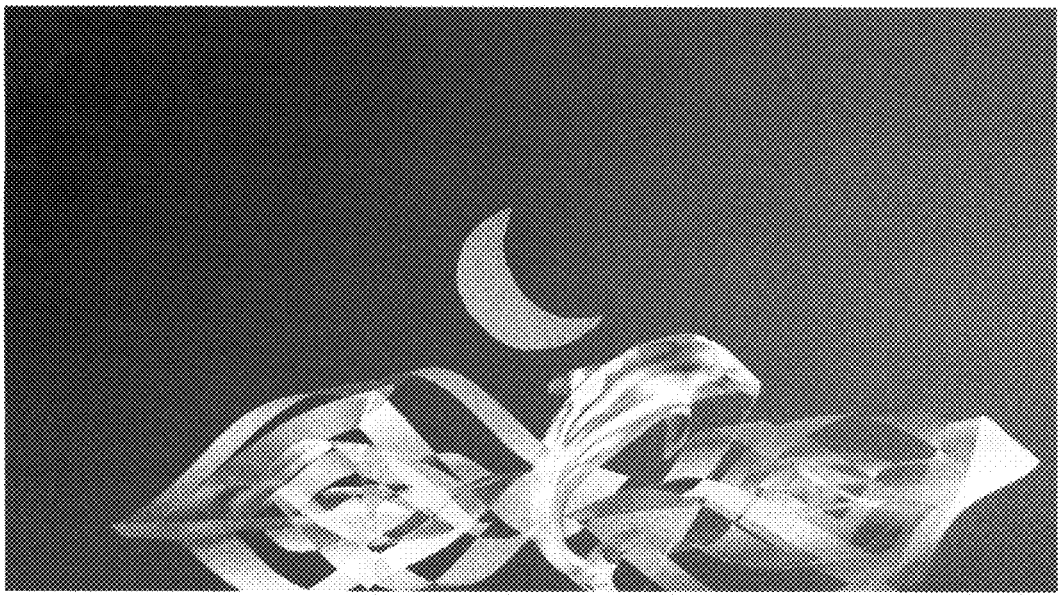
Figure 166:
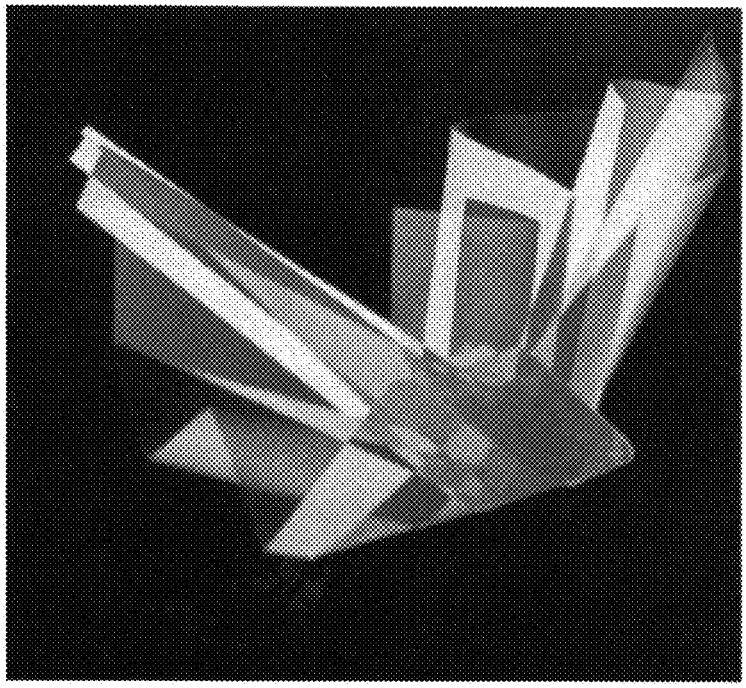
Figure 167:
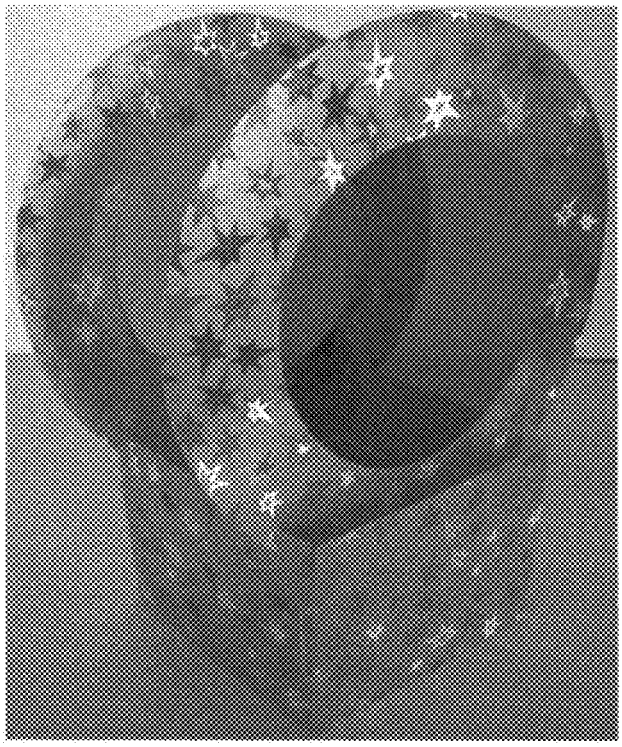

FIGS. 164-167 are color photographs of FIGS. 90, 92, 14, and 31, respectively. FIG. 164 illustrates color patterns created in photoelastic models under stress and polarized light. FIG. 165 illustrates the interacting color effects of photoelastic models and layered cellophane under polarized light. FIG. 166 illustrates color effects of layered cellophane under polarized light. FIG. 167 illustrated holographic graphics on the surface of a polariscope.

Photoelastic puzzles or figures can be arranged in 3D display. Soft flexible models can stick to one another because their surfaces tend to be adhesive and in some embodiments have means to be attached by other fixtures. They can be arranged in a variety of configurations due to the flexibility of the material.

The stickiness of these models allows them to serve as puppet strings for one other. The models can be stuck together, and by pulling on them movement is created. Hands can be used to manipulate the ends of a string of models between polarizing films, and if the string is long enough the hands will not be visible in the resulting display.

Origami/cut cellophane/adhesive tape displays/photoelastic puppets and puzzles are modular to fit a toy polariscope. Precut tape sets are made to have the pieces fit onto precut sheets of cellophane with suggested designs that would also fit onto the sized sheets that in turn fit within the range for viewing of the toy polariscope.

A toy polariscope in some embodiments is made from cardboard that is holographic and/or glow in the dark. In some embodiments, toy polariscopes that a user can decorate with paint, glitter, drawings, stickers, reflective material, mirrors, beads, precut designs, etc. (some or all of which may glow in the dark) are provided. The decoration materials are also provided.

A toy polariscope embodiment is foldable and unfoldable for ease of packaging, storage, and handling. It can fold in a variety of configurations to allow for multiple uses. It can be used in part and in whole to accommodate many needs such as a window display, viewing with or without glasses, multiple uses at a time, for example with more than one pair of glasses, in vertical and horizontal position with or without glasses, and using of the sky or a nonmetallic surface such as black glossy cardboard.

Placement of three slits in a polariscope stand allow for the insertion of art or photoelastic insert plate between two films in a base to be viewed between two films, as seen in FIGS. 127-128. With three top slits in a row, polarizing films can be inserted in the front and back slits and the object to be viewed in the middle slit, or the polarizing films can be placed in any two slits and the object to be viewed can be stuck to one of the polarizing films such that it is between the two polarizing films. This avoids the need for multiple stands.

The invention is not limited to the particular embodiments described above in detail. Those skilled in the art will recognize that other arrangements could be devised, for example, various polariscope structures, shapes of precut tape and cellophane, tools for manipulating the cellophane and tape and for manipulating photoelastic structures, etc. While the invention has been described with reference to specific illustrative embodiments, modifications and variations of the invention may be constructed without departing from the scope of the invention.

I claim:

1. A kit comprising translucent or transparent material comprising at least one of cellophane and adhesive tape and instructions for creating optical effects using the translucent or transparent material to form diffraction and interference patterns that show rainbow colors when viewed under polarized light, said kit further comprising at least one of manipulating tools and a photoelastic/photoplastic model, a stage or setting, and instructions for putting on a puppet show or telling a story with the translucent or transparent material, whereby the translucent or transparent material is configured to be used as puppets or in scenes of puppet shows or stories; and a puppet comprising one or more photoelastic/photoplastic objects and at least one of cellophane and adhesive tape serving as puppet strings for manipulating the photoelastic/photoplastic objects.

2. The kit of claim 1, wherein the translucent or transparent material glows in the dark.

3. The kit of claim 1, further comprising a light source, a first polarizing film, and a second polarizing film or polarizing glasses, whereby optical effects are produced by viewing the translucent or transparent material transmitted light from the light source through the first polarizing film, then through the translucent or transparent material, and then through the second polarizing film or polarizing glasses.

4. The kit of claim 1, further comprising a polarizing film or polarizing glasses, wherein optical effects are produced by viewing the translucent or transparent material with transmitted light from the polarizing effects of the blue sky, through the translucent or transparent material, and through the polarizing film or polarizing glasses.

5. The kit of claim 1, further comprising two polarizing films, wherein optical effects are produced by viewing the translucent or transparent material with transmitted light from ambient light though two polarizing films with the translucent or transparent material between them.

6. The kit of claim 1, further comprising a reflective surface and polarizing film or polarizing glasses, wherein optical effects are produced by viewing the translucent or transparent material with reflected light that first is polarized by reflection from the reflective surface, then passes through the translucent or transparent material, and then through the polarizing film or polarizing glasses.

7. The kit of claim 1, further comprising instructions, a cutting surface, and one or more tools for cutting, shaping, or punching out segments of translucent or transparent material for creating patterns of overlapping translucent or transparent material that will show the rainbow colors when viewed under polarized light.

8. The kit of claim 7, further comprising one or more of polarizing films, a reflective surface, and black glossy or other glossy surface.

9. The kit of claim 7, wherein the tools comprise at least one of a punch, a carving knife, and an awl.

10. The kit of claim 9, further comprising a container holding a liquid substance for application to the cellophane and/or adhesive tape and at least one of a brush and a dropper for applying the liquid substance.

11. The kit of claim 10, wherein the liquid substance comprises at least one of dye, irridescent paint, luminescent paint, oil, glitter, glow in the dark film, and adhesive.

12. The kit of claim 1, comprising a photoelastic/photoplastic model and at least one of strings, clamps, motors, springs, screws, and hooks configured to manipulate the photoelastic/photoplastic model under polarized light.

13. The kit of claim 1, further comprising a polarizing film.

14. The kit of claim 1, wherein the translucent or transparent material is pre-cut into shapes on a backing and can be peeled from the backing and applied to another surface to create optical art.

15. The kit of claim 14, wherein the transparent or translucent material comprises adhesive tape and cellophane on which the adhesive tape can be applied.

16. A method of using a kit comprising translucent or transparent material comprising plural separate layers of at least one of cellophane and adhesive tape and instructions for creating optical effects using the translucent or transparent material to form diffraction and interference patterns that show rainbow colors when viewed under polarized light, said method comprising:

manipulating at least one of photoelastic/photoplastic models, optical origami cellophane and tape art as puppets, said manipulating being selected from the list consisting of: deforming a shape; electronically altering liquid polarizing crystals; changing a thickness; changing a means of processing; changing a chemical composition; moving with hands; moving with strings; moving with clamps; moving with a motor; moving with springs; moving with hooks; moving with screws; moving with rings; moving with a stand; moving with a handle; moving with a lid; moving with a hinge; moving with slits; moving with a portal; moving with a frame; moving with a cellophane strip; moving with a cellophane background; moving with adhesive tape; stretching; twisting; bending; and moving supports;

creating a first layer of said plural separate layers;

creating a second layer of said plural separate layers; and adhering said first layer of said plural separate layers to said second layer of said plural separate layers thereby defining adhered layers, wherein light passing through said adhered layers transverse to said plural separate layers at a first location passes through the first layer and does not pass through the second layer, thereby defining a region of partial separation, and light passing through said toy transverse to said plural separate layers at a second location passes through the first layer and the second layer.

17. The method of claim 16, further comprising:

following directions for making origami models, wherein said following comprises folding the translucent or transparent material, and creating optical effects such as rainbow colors, said optical effects comprising at least one of diffraction and interference patterns when viewed under polarized light.

18. The method of claim 17, wherein the step of following directions further comprises folding, in sequential steps, the translucent or transparent material into a final end shape, wherein the final end shape displays a predetermined optical effect due to light diffraction and interference patterns when viewed under polarized light.

19. The method of claim 16, further comprising applying a liquid substance from a container to the at least one of cellophane and adhesive tape, wherein said applying is performed using at least one of a brush and a dropper.

20. The method of claim 16, further comprising folding the translucent or transparent or material into a geometric shape, plant or animal, wherein the translucent or transparent material further comprises at least one of cellophane and adhesive tape precut in a shape.

21. The method of claim 16, further comprising cutting, shaping, or punching out segments of the translucent or transparent material, said step of cutting, shaping, or punching out further comprising creating said patterns of overlapping translucent or transparent material with one or more tools, and passing a polarized light source through said overlapping segments of translucent or transparent material such that light from said polarized light source is refracted so as to viewably create the rainbow colors.

22. The method of claim 16, further comprising: configuring the translucent or transparent material into at least one of a puppet and a prop for a scene of a puppet show or story; and, putting on a puppet show or telling a story with the translucent or transparent material.

23. The method of claim 16, further comprising: reflecting light from a reflective surface; polarizing the reflected light; passing the reflected and polarized light through the translucent or transparent material; and then producing the optical effects by viewing the reflected, polarized and passed light through a polarizing film or polarizing glasses.

24. The method of claim 16, wherein said first layer and said second layer have an identical shape, and further comprising:

folding said adhered layers so as to create a concurrent fold, wherein said region of partial separation is created by said step of folding; and passing light through said region of partial separation, wherein said optical effects are created by said step of passing light through said region of partial separation.

25. The method of claim 16, wherein said first layer and said second layer have a non-identical shape, said region of partial separation exists as a result of said non-identical shape, and further comprising passing light through said region of partial separation, wherein said optical effects are created by said step of passing light through said region of partial separation.

* * * * *